US010286683B2

(12) United States Patent
Kobayashi

(10) Patent No.: US 10,286,683 B2
(45) Date of Patent: May 14, 2019

(54) EJECTION DEVICE FOR APPLYING DROPLETS OF FLUID TO OBJECT

(71) Applicant: FUNAI ELECTRIC CO., LTD., Osaka (JP)

(72) Inventor: Koichi Kobayashi, Daito (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 15/203,808

(22) Filed: Jul. 7, 2016

(65) Prior Publication Data

US 2017/0008305 A1 Jan. 12, 2017

(30) Foreign Application Priority Data

Jul. 9, 2015 (JP) ..... 2015-137979
Jun. 27, 2016 (JP) ..... 2016-126869

(51) Int. Cl.

| | |
|---|---|
| ***B41J 3/407*** | (2006.01) |
| ***B41J 2/14*** | (2006.01) |
| ***B41J 11/02*** | (2006.01) |
| ***A45D 29/22*** | (2006.01) |
| *A45D 29/00* | (2006.01) |

(52) U.S. Cl.

CPC ..... *B41J 3/4073* (2013.01); *A45D 29/22* (2013.01); *B41J 2/14* (2013.01); *B41J 11/02* (2013.01); *A45D 2029/005* (2013.01); *B41J 2002/14491* (2013.01)

(58) Field of Classification Search

CPC . B41J 3/4073; B41J 11/02; B41J 2/14; A45D 29/22; A45D 2029/005

See application file for complete search history.

(56) References Cited

U.S. PATENT DOCUMENTS

| | | | | |
|---|---|---|---|---|
| 5,782,379 | A * | 7/1998 | Traub | A45D 29/20 132/285 |
| 6,336,694 | B1 * | 1/2002 | Ishizaka | A45D 29/00 347/105 |
| 7,290,550 | B2 * | 11/2007 | Sim | G07F 17/26 101/35 |
| 8,757,171 | B2 * | 6/2014 | Goff | A45D 29/00 101/35 |
| 2005/0036813 | A1 | 2/2005 | Sim | |
| 2008/0094774 | A1 * | 4/2008 | Bucciferro | H01R 4/30 361/220 |
| 2012/0162322 | A1 * | 6/2012 | Tsuchiya | B41J 2/175 347/85 |

FOREIGN PATENT DOCUMENTS

| | | |
|---|---|---|
| CN | 1843257 | 10/2006 |
| CN | 1300748 | 2/2007 |
| JP | 2000322558 | 11/2000 |
| JP | 4162327 B2 * | 10/2008 |
| JP | 2012152410 | 8/2012 |

* cited by examiner

*Primary Examiner* — Sharon A. Polk
(74) *Attorney, Agent, or Firm* — JCIPRNET

(57) ABSTRACT

An ejection device is provided, which is capable of restricting movement of an object so as to discharge droplets of a fluid to the object stably as well as suppressing generation of static electricity. The ejection device has a discharge part, discharging a droplet to an object; a base, electrically grounded; and a fixing mechanism, disposed on the base and fixing the object. The fixing mechanism includes an electrically conductive material and is electrically connected with the base.

17 Claims, 19 Drawing Sheets

EJECTION DEVICE FOR APPLYING DROPLETS OF FLUID TO OBJECT

CROSS-REFERENCE TO RELATED APPLICATION

This application claims the priority benefit of Japan application serial no. 2015-137979, filed on Jul. 9, 2015, and Japan application serial no. 2016-126869, filed on Jun. 27, 2016. The entirety of each of the above-mentioned patent applications is hereby incorporated by references herein and made a part of this specification.

BACKGROUND OF THE INVENTION

Field of the Invention

The invention relates to an ejection device for applying droplets of a fluid or the like to an object.

Description of Related Art

For the purpose of applying a design to an object, printers, as an example of ejection devices, which are able to print colors or patterns on the object have become popular recently. Regarding such printers, placing mechanisms having a variety of configurations have been proposed for placing the object that is to be printed. In the case of applying a nail design to an object that is a fingernail, for example, there are nail printers capable of printing colors or patterns chosen by the user on the nail. For example, Patent Literature 1 (Japanese Patent Publication: JP 2012-152410) has disclosed placing the finger to be printed on a placing mechanism by a component that expands when a fluid is injected.

However, if there is a great distance between the nozzle of the ink printing mechanism (i.e., the ejection device) and the object, the ink may not get onto the correct position on the object and may result in a scrambled design. Thus, for the printer, the distance between the nozzle and the object is generally set to be very short, e.g., about several mm. Moreover, the human finger or metal object that serves as the object usually carries static electricity. If the static electricity is discharged from the fingernail or the metal object to the nozzle, it may lead to malfunction or damage of the nozzle. Therefore, it is necessary to take measures to deal with the static electricity.

SUMMARY OF THE INVENTION

The invention is to restrict movement of the object to achieve stable printing as well as suppress generation of static electricity by devising a positioning structure for the ejection device.

In view of the above, the invention uses an object positioning part composed of an electrically conductive material that is electrically connected with an electrically grounded base to restrict movement of the object so as to perform printing stably, and discharges the static electricity carried by the object to the positioning part, so as to suppress generation of the static electricity.

Specifically, according to the first embodiment of the invention, an ejection device includes a discharge part discharging a droplet to an object, a base that is electrically grounded, and a fixing mechanism disposed on the base and fixing the object. The fixing mechanism includes an electrically conductive material electrically connected with the base.

According to the first embodiment, because movement of the object is restricted by the fixing mechanism, an ink printing mechanism, as an example of the discharge part, is able to perform printing on the object stably. Moreover, because the fixing mechanism includes an electrically conductive material electrically connected with the grounded base, the fixing mechanism is electrically grounded. Therefore, by making the object fixed by the fixing mechanism in contact with the fixing mechanism, movement of the object is restricted and the static electricity carried by the object is discharged to the fixing mechanism. Accordingly, the ejection device of the first embodiment is capable of restricting movement of the object for the ink printing mechanism to perform printing stably as well as suppressing generation of static electricity. As a result, the static electricity carried by the object is properly discharged and malfunction of a nozzle caused by the static electricity may be prevented in advance.

According to the second embodiment of the invention, based on the first embodiment, the fixing mechanism includes a support part disposed on the base, and a positioning part disposed on the support part and restricting movement of the object, and the support part and the positioning part includes an electrically conductive material.

According to the third embodiment of the invention, based on the second embodiment, the positioning part includes a body part disposed on the support part, an urging member disposed in the body part, and a gripping part having an end coupled to the urging member and the other end in contact with the object.

According to the fourth embodiment of the invention, based on the first embodiment, the fixing mechanism includes the positioning part disposed on the base and restricting movement of the object, and the positioning part includes an electrically conductive material.

According to the fifth embodiment of the invention, based on the fourth embodiment, the positioning part includes the body part disposed on the base, the urging member disposed in the body part, and the gripping part having one end coupled to the urging member and the other end in contact with the object.

According to the second to the fifth embodiments, movement of the object is restricted for the ink printing mechanism to perform printing stably, and generation of static electricity is also suppressed. As a result, the static electricity carried by the object is properly discharged and malfunction of the nozzle caused by the static electricity may be prevented in advance.

According to the sixth embodiment of the invention, based on the first embodiment, the fixing mechanism further includes a placing part on which the object is placed. According to the seventh embodiment of the invention, based on the sixth embodiment, the fixing mechanism includes the positioning part which is disposed to face the placing part and is in contact with the object placed on the placing part to restrict movement of the object.

According to the sixth to the seventh embodiments, movement of the object is restricted for the ink printing mechanism to perform printing stably, and generation of static electricity is also suppressed. As a result, the static electricity carried by the object is properly discharged and malfunction of the nozzle caused by the static electricity may be prevented in advance.

In the ejection device of the eighth embodiment, based on the seventh embodiment, the positioning part includes a contact part which is curved in a concave shape to conform to a cross-sectional shape of the object placed on the placing part.

According to the eighth embodiment, because the contact part is curved in the concave shape, when the contact part covers the object placed on the placing part, the area of contact between the positioning part and the object increases. Thus, movement of the object is restricted easily and the static electricity carried by the object is easily discharged by the positioning part.

In the ejection device of the ninth embodiment, based on any of the sixth to the eighth embodiments, the placing part is disposed movably in a direction toward or away from the positioning part, and the fixing mechanism includes an urging member which urges the placing part toward the positioning part to bring the object placed on the placing part into contact with the positioning part.

According to the ninth embodiment, because the movable placing part is urged toward the positioning part by the urging member, movement of the object with respect to the positioning part is more strongly restricted for the ink printing mechanism to perform printing on the object stably. In addition, because the object placed on the placing part is pressed against the positioning part by the urging member, the static electricity carried by the object remains to be discharged by the positioning part, such that generation of static electricity is suppressed.

In the ejection device of the tenth embodiment, based on the ninth embodiment, the fixing mechanism includes a placing holder on which the placing part is formed and which is movable in the direction toward or away from the positioning part, and the placing holder is urged in the direction toward the positioning part by an urging force of the urging member.

According to the tenth embodiment, it is easy to place the object on the placing part of the placing holder and movement of the object placed on the placing part of the placing holder is restricted by the positioning part for the ink printing mechanism to perform printing on the object stably. In addition, because the object placed on the placing part of the placing holder is pressed against the positioning part by the urging force of the urging member, the static electricity carried by the object remains to be discharged by the positioning part, such that generation of static electricity is suppressed.

In the ejection device of the eleventh embodiment, based on the tenth embodiment, the urging member includes an electrically conductive material electrically connected with the base. In the ejection device of the twelfth embodiment, the placing holder includes an electrically conductive material electrically connected with the urging member.

According to the eleventh to the twelfth embodiments, the placing holder is electrically grounded via the urging member and the base. Thus, when the object is placed on the placing part of the placing holder, the static electricity carried by the object is discharged to the placing holder. Consequently, generation of static electricity is suppressed by the placing holder together with the positioning part.

In the ejection device of the thirteenth embodiment, based on any of the tenth to the twelfth embodiments, the fixing mechanism includes a support part which supports the positioning part on the base and includes an electrically conductive material electrically connected with the base and the positioning part respectively, and a connection part composed of an electrically conductive material to electrically connect the placing holder and the support part is disposed.

According to the thirteenth embodiment, the placing holder is electrically connected with the base via the connection part and the support part to be electrically grounded. Therefore, when the object is placed on the placing part of the placing holder, the static electricity carried by the object is discharged by the placing holder.

In the ejection device according to the fourteenth embodiment, based on the thirteenth embodiment, the support part includes a pair of support parts disposed on two lateral sides of the placing holder, the connection part is integrally and movably disposed on two end parts of the placing holder, and the connection part includes an elastic material to be slidably in contact with the pair of support parts respectively.

According to the fourteenth embodiment, because the connection part is maintained slidably in contact with the pair of support parts, the placing holder is constantly electrically connected with the base via the connection part and the pair of support parts to be electrically grounded. Therefore, when the object is placed on the placing part of the placing holder, the static electricity carried by the object remains to be discharged by the placing holder.

In the ejection device according to the fifteenth embodiment, based on any of the first to the fourteenth embodiments, the fixing mechanism includes a receiving part composed of an electrically conductive material electrically connected with the base, and a main body detachably disposed in the receiving part and at least including the positioning part. The main body is configured such that the positioning part is electrically connected with the receiving part when the main body is installed in the receiving part.

According to the fifteenth embodiment, same as the first embodiment, movement of the object is restricted by the positioning part for the ink printing mechanism to perform printing stably. Moreover, the static electricity carried by the object remains to be discharged by the positioning part and therefore generation of static electricity is suppressed.

In the ejection device according to the sixteenth embodiment, based on the fifteenth embodiment, a detector is disposed which detects that the main body is installed in the receiving part at a regular position where the positioning part is electrically connected with the receiving part.

According to the sixteenth embodiment, for example, a case where the main body is not installed at the regular position in the receiving part is detected by the detector, so as to presume that the static electricity carried by the object may not be properly discharged by the positioning part.

In the ejection device of the seventeenth embodiment, based on the sixteenth embodiment, the main body includes a first electrode which is electrically connected with the positioning part, and the receiving part includes a second electrode which is electrically connected with the base and is in contact with the first electrode when the main body is installed at the regular position. The detector determines that the main body is not installed at the regular position in the receiving part if the detector detects a state that the first electrode and the second electrode are not in contact when the main body is installed in the receiving part and a signal pulled up by the contact between the first electrode and the second electrode is not at a ground level.

According to the seventeenth embodiment, the detector presumes that the static electricity carried by the object may not be properly discharged if the main body is not installed at the regular position in the receiving part and the first and the second electrodes are not in contact, and the signal pulled up by the contact of the two electrodes is at the ground level, so as to prevent malfunction of the nozzle caused by the static electricity in advance.

In the ejection device according to the eighteenth embodiment, based on any of the fifteenth to the seventeenth embodiments, the fixing mechanism further includes a holding part which maintains a state where the main body is installed at the regular position in the receiving part to electrically connect the positioning part and the receiving part with each other.

According to the eighteenth embodiment, the static electricity carried by the object remains to be properly discharged by the positioning part.

The ejection device of the invention is capable of restricting movement of the object to achieve stable printing as well as suppressing generation of static electricity.

DESCRIPTION OF THE EMBODIMENTS

Hereinafter, embodiments of the invention are described in detail with reference to the figures. The description of the embodiments below is merely exemplary in nature and is not intended to limit the invention, application, or use thereof. Moreover, in the following embodiments, a printer and an ink printing mechanism thereof are described as examples of an ejection device and a discharge part respectively.

First Embodiment

Figure 1:
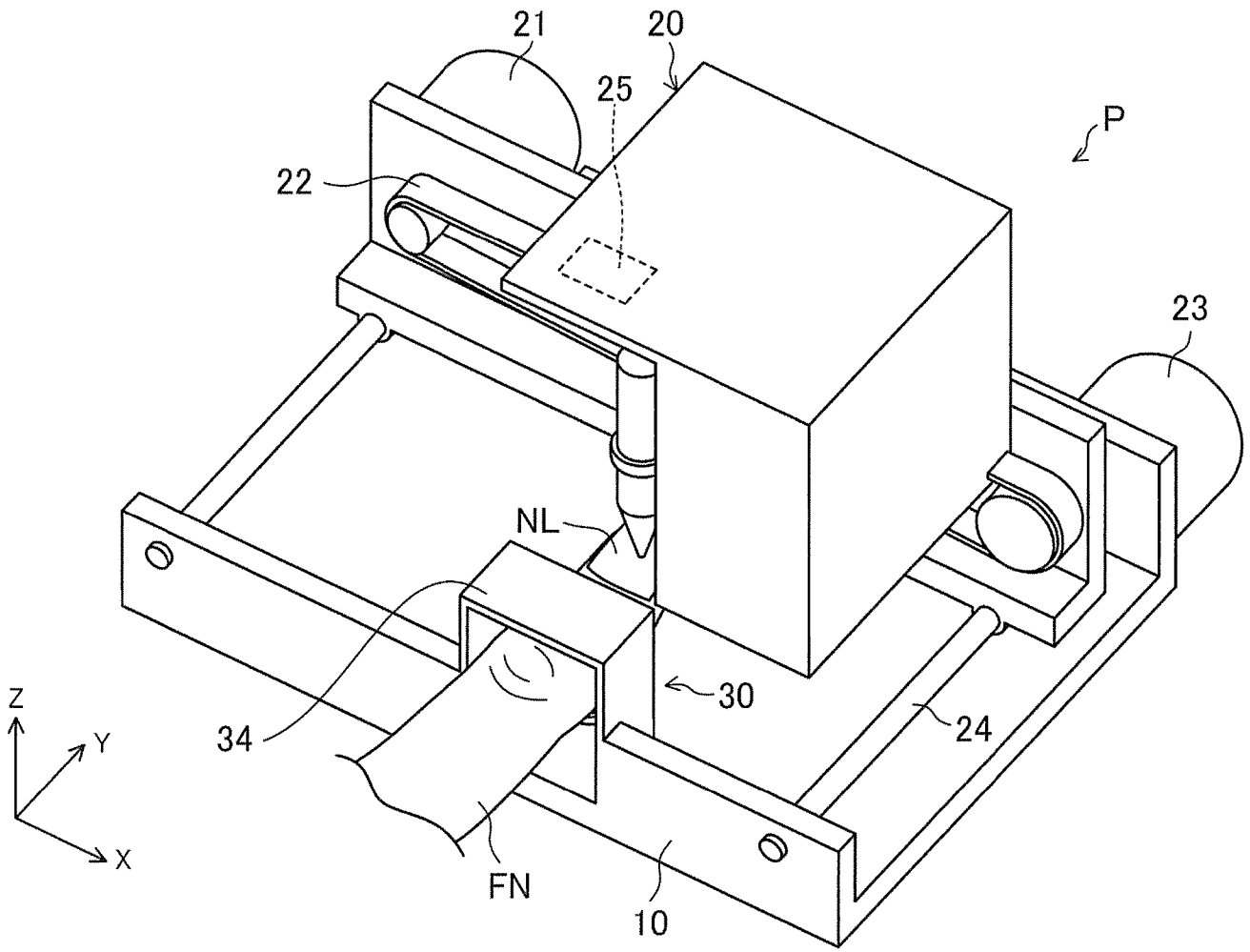
FIG. 1 is a perspective view showing a printer according to the first embodiment of the invention.

FIG. 1 illustrates a printer P according to the first embodiment. In the first embodiment, the printer performs printing on a fingernail NL of a user, which serves as an object. As shown in FIG. 1, a side where a fixing mechanism 30 (which will be described later) is disposed is defined as a front side, a horizontal left-right direction of the fixing mechanism 30 on the front side is defined as an X direction, a horizontal front-rear direction orthogonal to the X direction (a direction in which a finger of the user points, which corresponds to the front-rear direction of the fixing mechanism 30) is defined as a Y direction, and a vertical up-down direction respectively orthogonal to the X direction and the Y direction is defined as a Z direction. Moreover, in FIG. 1, the configuration of the fixing mechanism 30 is illustrated in a simplified manner. In addition, although the first embodiment illustrates a case where the finger of the user serves as the object, the object may be things other than the finger and may be a metal object, for example. The fixing mechanism 30 of the embodiment is for the finger, for example; however, if the object is other than the finger, the size of the fixing mechanism 30 may be modified to correspond to different objects. If the object is not specified as the finger in the embodiment, the finger may also be the object.

Figure 2:
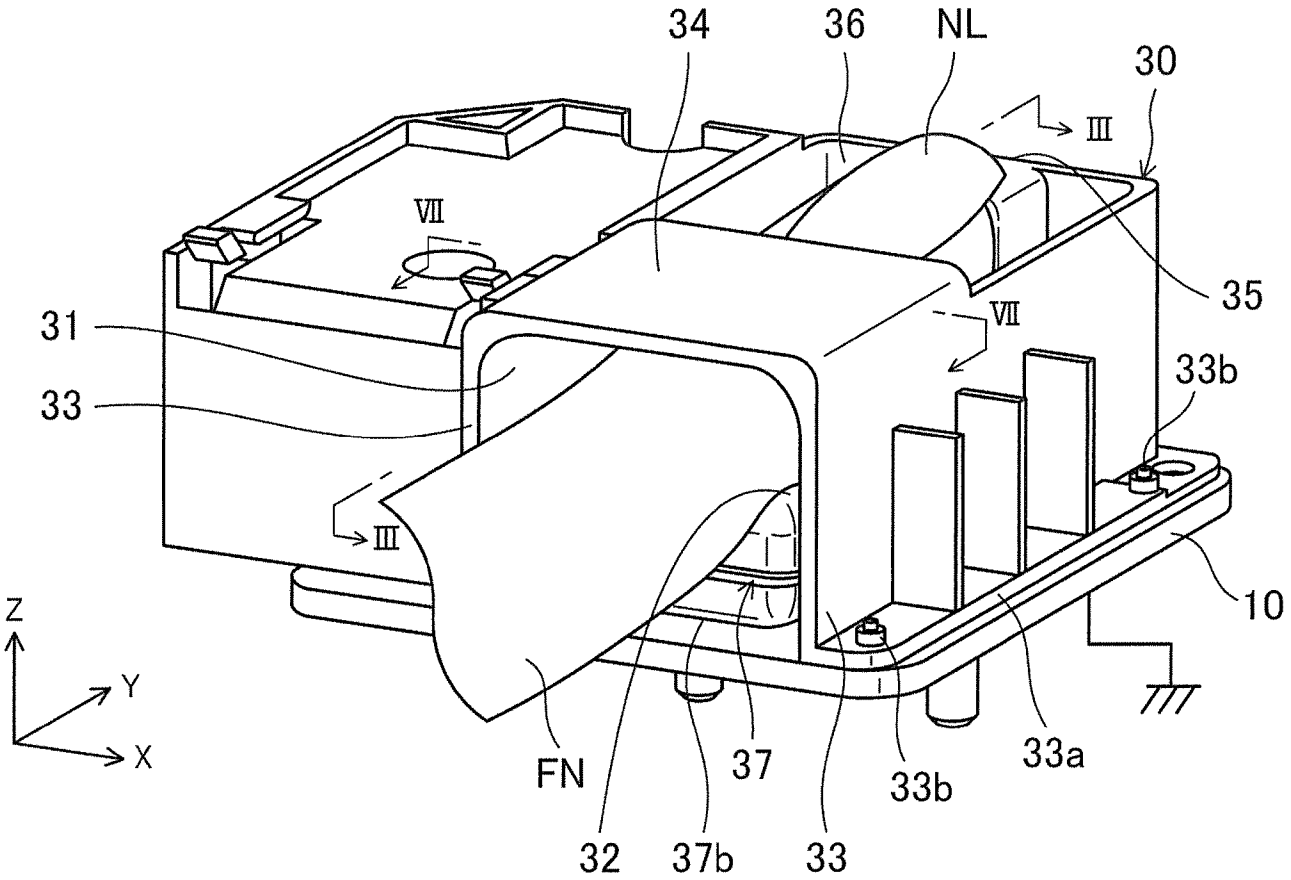
FIG. 2 is a perspective view showing a fixing mechanism according to the first embodiment.

The printer P includes a base 10, as shown in FIG. 1. The base 10 is composed of an electrically conductive material such as a metal material, for example, and is used as a housing for disposing components of the printer P. As shown in FIG. 2, the base 10 is electrically grounded.

Figure 3:
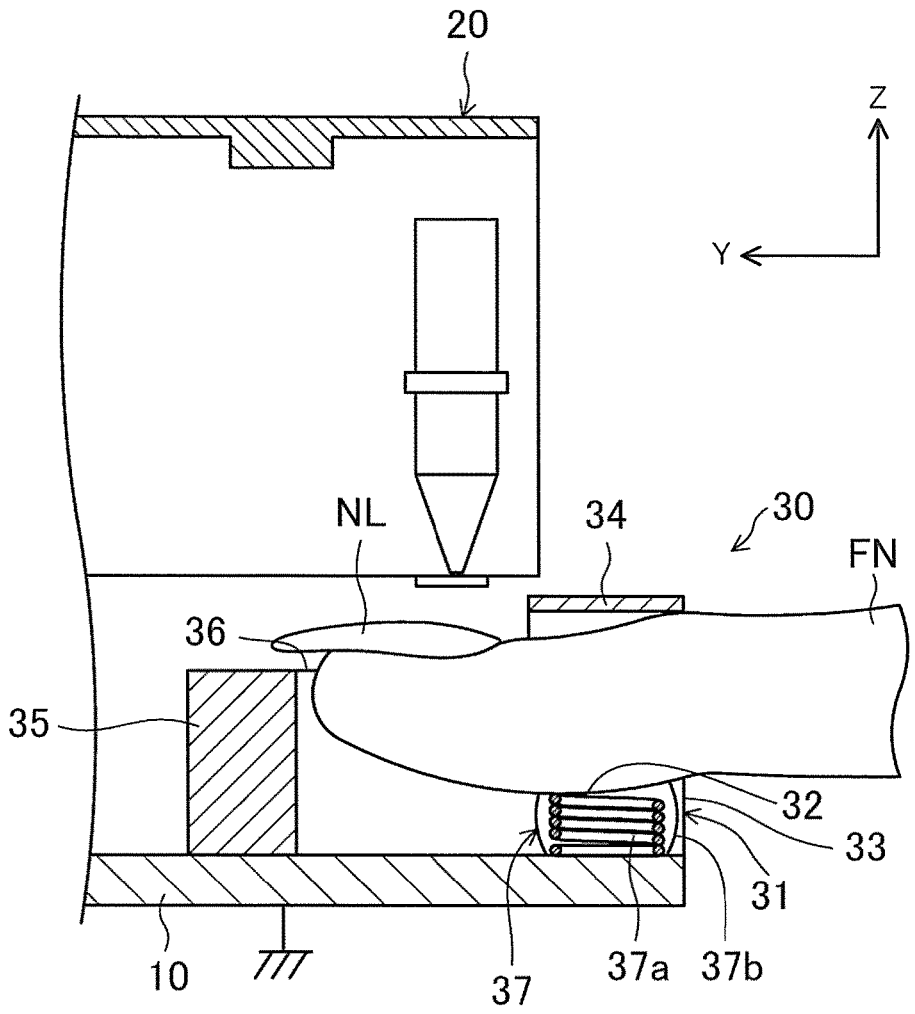
FIG. 3 is a cross-sectional view taken along the line of FIG. 2.

As shown in FIG. 1 and FIG. 3, an ink printing mechanism 20 is provided on an upper side of the base 10. The ink printing mechanism 20 is configured to perform printing on the fingernail NL of the user placed by the fixing mechanism 30 (which will be described later). Specifically, as shown in FIG. 1, the printer P drives an X-axis motor belt 22 connected with an X-axis motor 21, such that the ink printing mechanism 20 connected with the X-axis motor belt 22 moves in the X direction. In addition, the printer P rotates a Y-axis motor shaft 24 connected with a Y-axis motor 23, such that the ink printing mechanism 20 connected with the Y-axis motor shaft 24 moves in the Y direction. Moreover, a camera 25 is provided in the ink printing mechanism 20. The camera 25 captures an image of the fingernail NL placed on a placing part 32, which will be described later. The image captured by the camera 25 is used for identifying an operation range of the ink printing mechanism 20 with respect to the fingernail NL.

Figure 4:
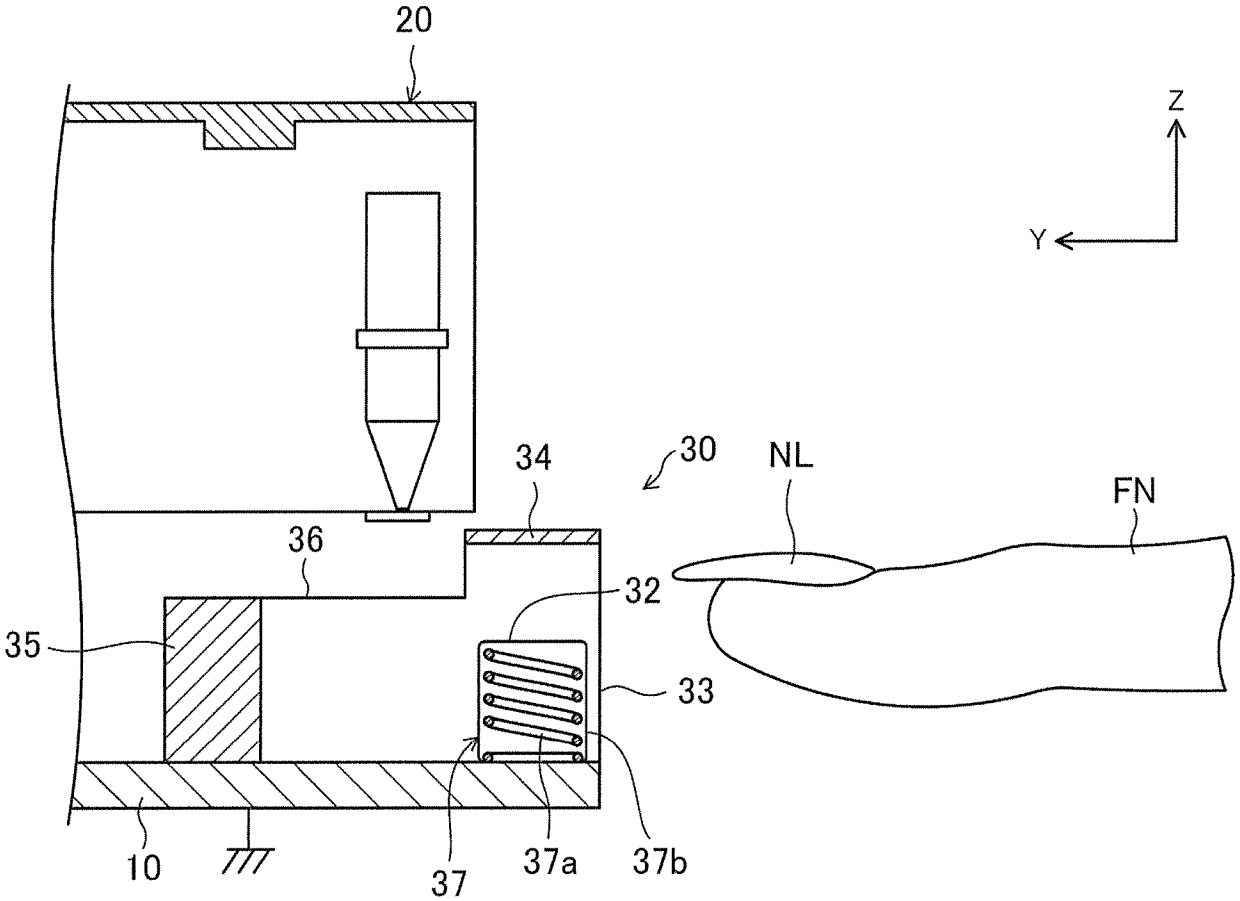
FIG. 4 corresponds to FIG. 3 and shows a state before a finger that serves as the object is inserted into the fixing mechanism.

As shown in FIG. 1, the fixing mechanism 30, which is for placing the fingernail NL of the user that serves as the object for the ink printing mechanism 20, is provided on the base 10. In addition, as shown in FIG. 2 to FIG. 4, the placing part 32 for placing a finger NF of the user is disposed in the fixing mechanism 30. In the first embodiment, the placing part 32 is formed on an upper surface of a housing body 37*b* that constitutes an urging member 37 which will be described later.

As shown in FIG. 2, in the fixing mechanism 30, an insertion part 31 shaped like an arch in the front view is disposed on an upper surface of the base 10. The finger FN of the user is inserted into the fixing mechanism 30 from the insertion part 31 in the Y direction to be placed on the placing part 32. The insertion part 31 includes a pair of left and right support parts 33 respectively having a wall shape on two sides of the placing part 32 in the X direction, and a positioning part 34 between upper portions of the pair of left and right support parts 33.

As shown in FIG. 2, attachment pieces 33*a* (only one is shown) that protrude outward in the X direction are provided on lower portions of the pair of support parts 33. The attachment pieces 33*a* are fixed to an upper part of the base 10 by screws 33*b*. Movement of the finger FN of the user placed on the placing part 32 in the left-right direction (the X direction) is restricted by the pair of left and right support parts 33. The support parts 33 are composed of an electrically conductive material (e.g., an electrically conductive resin). That is, the support parts 33 are electrically connected with the base 10 and thus are electrically grounded.

As shown in FIG. 2 to FIG. 4, the positioning part 34 is supported by the base 10 by the pair of left and right support parts 33 and is disposed above the placing part 32 to face the placing part 32. The positioning part 34 has a flat plate shape and is configured such that an inner surface (lower surface) thereof which faces the placing part 32 is in contact with an upper side of the finger FN of the user placed on the placing part 32. That is, the finger FN of the user placed on the placing part 32 is in contact with the inner surface of the positioning part 34, so as to restrict movement of the finger FN of the user in the up-down direction (the Z direction). The positioning part 34 is composed of an electrically conductive material (e.g., an electrically conductive resin). That is, the positioning part 34 is electrically connected with the base 10 via the pair of left and right support parts 33 and thus is electrically grounded.

Further, as shown in FIG. 2, a front wall part 35 having a substantially U shape in the plan view, which is connected with front sides of the pair of left and right support parts 33, is formed at a front end side of the positioning part 34 in the Y direction. The forward movement (the Y direction) of the finger FN of the user placed on the placing part 32 is restricted by the front wall part 35. Besides, as shown in FIG. 2 and FIG. 3, an opening part 36 that is open on the upper side is formed between the front wall part 35 and the positioning part 34 on the front end side of the positioning part 34 in the Y direction. Through the opening part 36, the printing performed by the ink printing mechanism 20 is applied to the fingernail NL of the user placed on the placing part 32 from above. In this embodiment, the pair of left and right support parts 33, the positioning part 34, and the front wall part 35 are formed integrally.

As described above, because movement of the finger FN of the user placed on the placing part 32 is restricted by the positioning part 34, the ink printing mechanism 20 is able to perform printing on the fingernail NL of the user stably. Moreover, because the positioning part 34 is composed of the electrically conductive material that is electrically connected with the grounded base 10, the positioning part 34 itself is electrically grounded. Therefore, by bringing the finger FN of the user placed on the placing part 32 into contact with the positioning part 34, movement of the fingernail NL of the user is restricted and the static electricity carried by the finger FN of the user is discharged to the positioning part 34. Accordingly, the printer P of the first embodiment is capable of restricting movement of the finger FN of the user for the ink printing mechanism 20 to perform printing stably as well as suppressing generation of static electricity. As a result, since the static electricity carried by the finger FN of the user is properly discharged, malfunction of the nozzle caused by the static electricity may be prevented in advance.

Moreover, the fixing mechanism 30 is provided with the urging member 37, which urges the placing part 32 toward the positioning part 34 so as to bring the finger FN of the user placed on the placing part 32 into contact with the positioning part 34. The urging member 37 is attached to the upper surface of the base 10. The urging member 37 of the first embodiment includes a coiled compression spring 37*a* as an elastic body and the expandable bag-shaped housing body 37*b* that houses the compression spring 37*a* therein. Additionally, as shown in FIG. 3, the placing part 32 is disposed on the upper surface of the housing body 37*b* for placing the finger FN of the user that is inserted from the insertion part 31 of the positioning part 34.

As shown in FIG. 4, when the finger FN of the user is not placed on the placing part 32, the compression spring 37*a* is in an upward extended state. Then, as shown in FIG. 3, when the finger FN of the user is inserted from the insertion part 31 of the positioning part 34 to press down the urging member 37 and placed on the placing part 32 against an urging force of the compression spring 37*a*, due to the urging force of the compression spring 37*a*, the placing part 32 on which the finger FN of the user is placed is urged upward toward the positioning part 34. That is, because of the urging force of the compression spring 37*a*, the upper side of the finger FN of the user placed on the placing part 32 is maintained in a state of being pressed against the inner surface of the positioning part 34. In this state, the ink printing mechanism 20 operates to apply printing on the fingernail NL of the user.

Because such action of the urging member 37 (the compression spring 37*a*) more strongly restricts movement of the finger FN of the user with respect to the positioning part 34, the ink printing mechanism 20 is able to print the fingernail NL of the user stably. In addition, the urging force of the compression spring 37*a* presses the finger FN of the user placed on the placing part 32 against the positioning part 34, by which the static electricity carried by the finger FN of the user remains to be discharged by the positioning part 34. Thus, generation of static electricity is suppressed.

Second Embodiment

Figure 5:
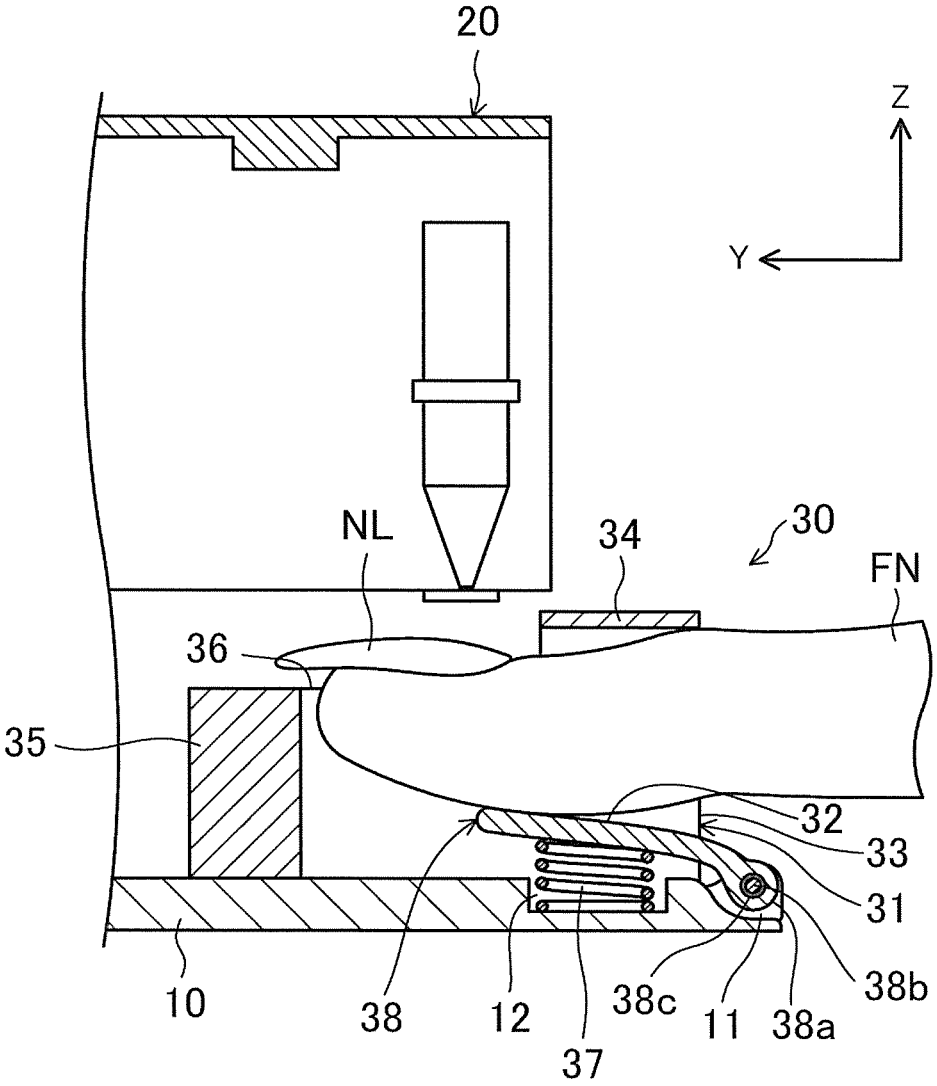
FIG. 5 corresponds to FIG. 3 and shows the fixing mechanism according to the second embodiment of the invention.
Figure 6:
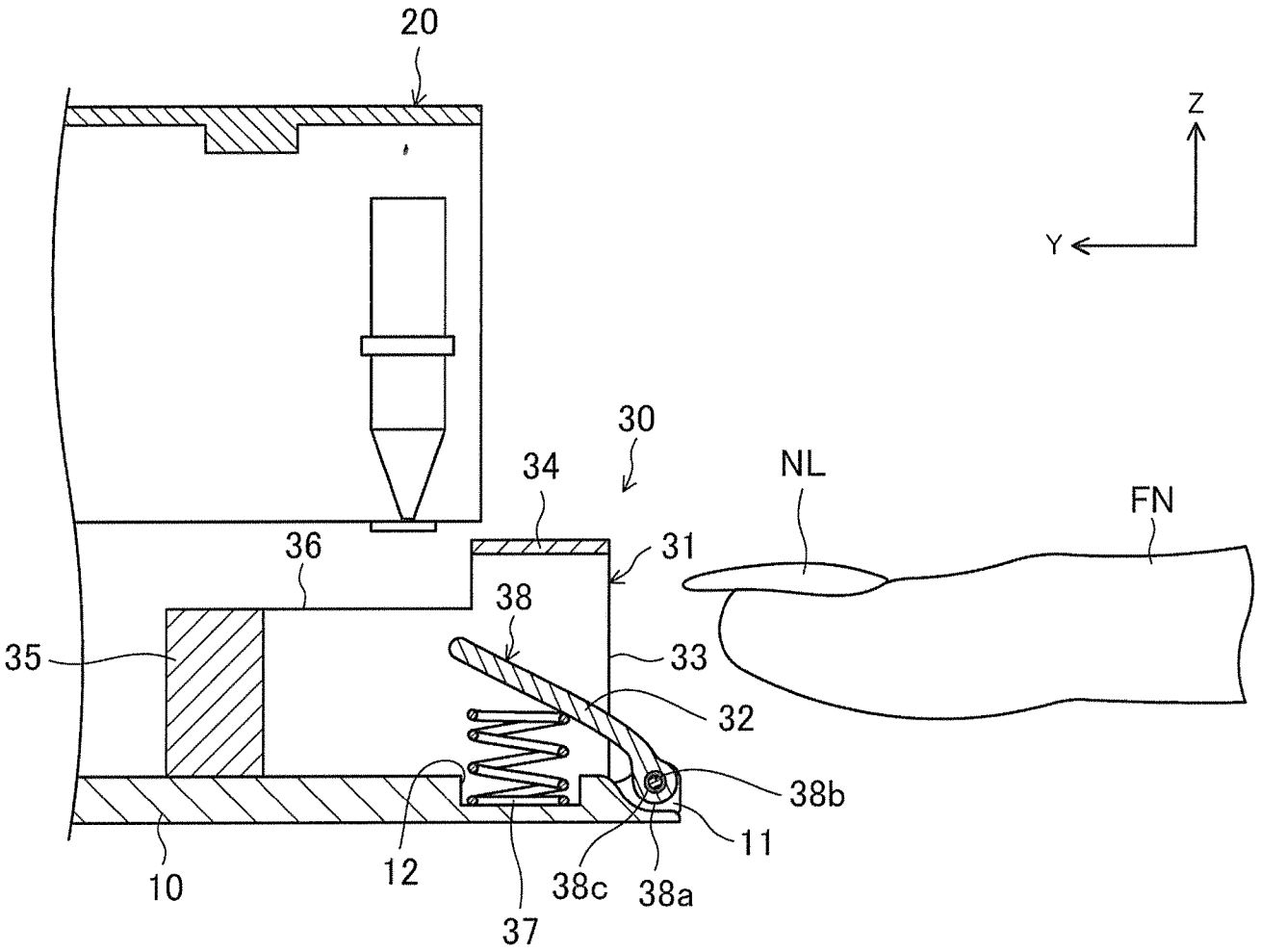
FIG. 6 corresponds to FIG. 4 and shows the fixing mechanism according to the second embodiment.

FIG. 5 and FIG. 6 illustrate the fixing mechanism 30 of the printer P according to the second embodiment of the invention. The printer P of this embodiment further includes a placing holder 38 as a part of the fixing mechanism 30 of the first embodiment. Moreover, the urging member 37 is replaced by a structure that is composed of the coiled compression spring 37*a* but does not include the housing body 37*b*. Other parts of the configuration of the printer P of this embodiment are the same as those of the configuration of the printer P of the first embodiment. Therefore, in the description of this embodiment, parts the same as those of FIG. 1 to FIG. 4 are assigned with the same reference numerals and detailed descriptions thereof are omitted hereinafter (the same applies to the following embodiments). Likewise, although the second embodiment illustrates a case where the finger of the user serves as the object, the object may be things other than the finger and may be a metal object, for example.

As shown in FIG. 5 and FIG. 6, the placing holder 38 is disposed under the positioning part 34 on the inner side of the pair of left and right support parts 33. The placing holder 38 has a lever shape and includes a boss part 38*a*, through which a shaft insertion hole 38*c* is formed, and the placing part 32, which is formed in a flat plate shape that is continuous with the boss part 38*a*. The boss part 38*a* is disposed to be fitted between a pair of left and right boss attachment parts 11 (only one is shown) formed on the base 10, and a rotating shaft 38*b* that is hung between the boss attachment parts 11 to extend in the X direction is inserted through the shaft insertion hole 38*c* of the boss part 38*a*, by which the placing holder 38 is supported swingably in the up-down direction (the Z direction) around the rotating shaft 38*b* with respect to the base 10. In other words, the placing holder 38 is configured to be movable in a direction toward or away from the positioning part 34, and the finger FN of the user inserted from the insertion part 31 of the positioning part 34 is placed on the upper surface of the placing part 32 of the placing holder 38.

The urging member 37 composed of the coiled compression spring is disposed under the placing part 32 of the placing holder 38. The urging member 37 (compression spring) in this embodiment is attached between an inner bottom surface of a recess 12 formed on the upper surface of the base 10 and a lower surface of the placing part 32.

In this embodiment, as shown in FIG. 6, when the finger FN of the user is not placed on the placing part 32, the urging member 37 is extended upwards, and due to the urging force of the urging member 37, the placing holder 38 tilts upward. Then, as shown in FIG. 5, when the finger FN of the user is inserted from the insertion part 31 of the positioning part 34 to press down the urging member 37 and placed on the placing part 32 against the urging force of the urging member 37, due to the urging force of the urging member 37, the placing part 32 of the placing holder 38, on which the finger FN of the user is placed, is urged upward toward the positioning part 34. That is, because of the urging force of the urging member 37, the upper side of the finger FN of the user placed on the placing part 32 of the placing holder 38 is maintained in a state of being pressed against the inner surface of the positioning part 34. In this state, the ink printing mechanism 20 operates to apply printing on the fingernail NL of the user.

In this way, the placing holder 38 is a lever-shaped member that is swingable in a direction toward or away from the positioning part 34 and is urged in the direction toward the positioning part 34 by the urging force of the urging member 37. Therefore, the finger FN of the user may be easily placed on the placing part 32 of the placing holder 38 and movement of the finger of the user placed on the placing part 32 of the placing holder 38 is restricted by the positioning part 34 for the ink printing mechanism 20 to print the fingernail NL of the user stably. In addition, due to the urging force of the urging member 37, the finger FN of the user placed on the placing part 32 of the placing holder 38 is pressed against the inner surface of the positioning part 34. Accordingly, the static electricity carried by the finger FN of the user remains to be discharged by the positioning part 34 and generation of static electricity is suppressed.

Variation of the Second Embodiment

As a variation of the second embodiment, the urging member 37 may be composed of an electrically conductive material that is electrically connected with the base 10 and the placing holder 38 may be composed of an electrically conductive material that is electrically connected with the urging member 37. In this case, the placing holder 38 is electrically grounded via the urging member 37 and the base 10. Accordingly, when the finger FN of the user is placed on the placing part 32 of the placing holder 38, the static electricity carried by the finger FN of the user is discharged to the placing holder 38. Consequently, in addition to the aforementioned effect brought by the positioning part 34, generation of static electricity is suppressed by the placing holder 38 as well.

Third Embodiment

Figure 7:
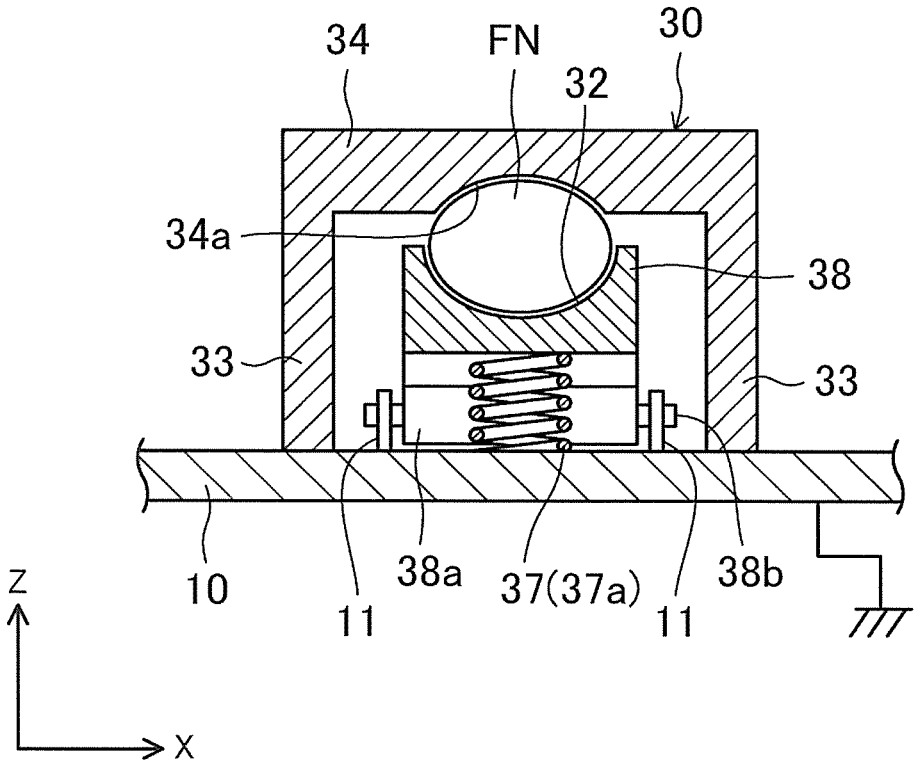
FIG. 7 is a cross-sectional view taken along the line VII-VII of FIG. 2 showing the fixing mechanism according to the third embodiment of the invention.

FIG. 7 illustrates the fixing mechanism 30 of the printer P according to the third embodiment of the invention. In the printer P of this embodiment, the shapes of the positioning part 34 and the placing holder 38 of the second embodiment are modified. Other parts of the configuration are the same as those of the second embodiment. Likewise, although the third embodiment illustrates a case where the finger of the user serves as the object, the object may be things other than the finger and may be a metal object, for example.

That is, as shown in FIG. 7, a contact part 34*a* is formed on the lower surface of the positioning part 34. The contact part 34*a* is curved in a concave shape to conform to a cross-sectional shape of the object (i.e., the finger FN of the user) placed on the placing part 32 of the placing holder 38. In other words, the contact part 34*a* is formed to cover a substantially upper half of the finger FN of the user placed on the placing part 32. Thus, the area of contact between the positioning part 34 and the finger FN of the user placed on the placing part 32 increases. Thereby, movement of the fingernail NL of the user is restricted easily and the static electricity carried by the finger FN of the user is easily discharged by the positioning part 34.

Furthermore, the placing part 32 of the placing holder 38 is also curved in a concave shape to conform to the cross-sectional shape of the finger FN of the user. With such a shape, the placing part 32 of the placing holder 38 together with the contact part 34*a* of the positioning part 34 is able to hold and completely cover the finger FN of the user from the up-down direction.

Fourth Embodiment

Figure 8:
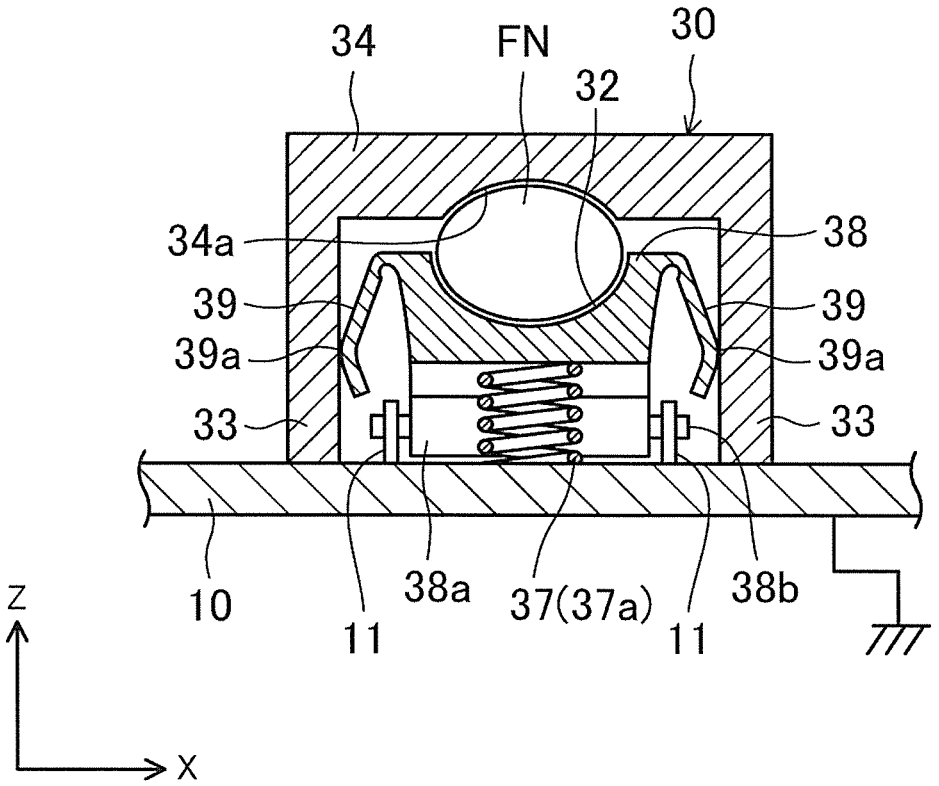
FIG. 8 corresponds to FIG. 7 and shows the fixing mechanism according to the fourth embodiment of the invention.
Figure 9:
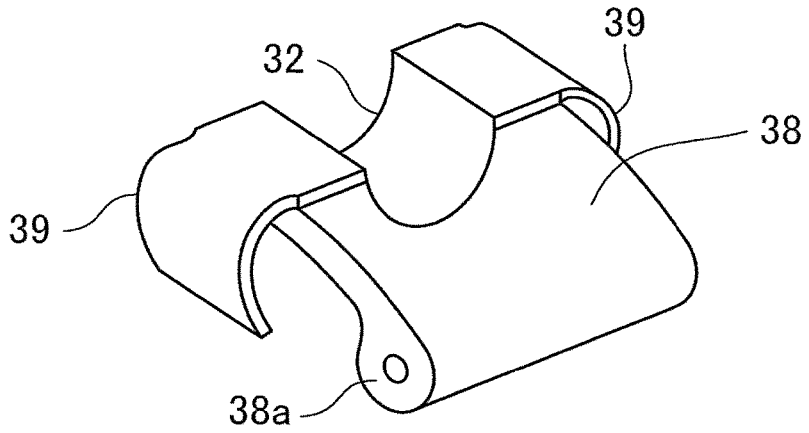
FIG. 9 is a perspective view showing the configuration of a placing holder and a connection part.

FIG. 8 and FIG. 9 illustrate the fixing mechanism 30 of the printer P according to the fourth embodiment of the invention. The printer P of this embodiment further includes connection parts 39 that electrically connect the placing holder 38 and the support parts 33 of the third embodiment. Other parts of the configuration are the same as those of the third embodiment. Likewise, although the fourth embodiment illustrates a case where the finger of the user serves as the object, the object may be things other than the finger and may be a metal object, for example.

That is, as shown in FIG. 8, the pair of left and right support parts 33 is provided on two sides of the placing holder 38. Moreover, a pair of plate-shaped connection parts 39 composed of an elastic body, such as a plate spring, is respectively provided on two end parts of the placing holder 38. As shown in FIG. 9, the connection parts 39 are respectively formed integrally with the placing holder 38. The connection parts 39 respectively extend from left and right sides of the placing part 32 to two lateral sides of the placing holder 38 and then extend to curve downward and inward from the upper end of the placing holder 38. A sliding contact part 39*a* is formed on an outer side of the curved portion to be in sliding contact with the inner surface of the support part 33. Additionally, in a free state where the placing holder 38 is not disposed between the pair of left and right support parts 33, a maximum distance between the connection parts 39 in the X direction (distance between the sliding contact parts 39*a*) is formed to be greater than an inner width of the pair of left and right support parts 33. Therefore, when the placing holder 38 is disposed between the support parts 33, the connection parts 39 respectively generate a rotational urging force in which a joint portion with the placing holder 38 is as a starting point, and generate an elastic force against the support parts 33. In this way, the connection parts 39 are integrally movably disposed on two end parts of the placing holder 38, and the connection parts 39 are slidably in elastic contact with the pair of support parts 33 respectively.

Moreover, in this embodiment, the placing holder 38 and the connection parts 39 are composed of an electrically conductive material. As shown in FIG. 8, the connection parts 39 are in elastic contact with the support parts 33 that are composed of an electrically conductive material, such that the placing holder 38 is electrically connected with the base 10 via the contact part 34*a* and the pair of support parts 33. That is, the placing holder 38 is electrically connected with the base 10 via the connection parts 39 and the pair of support parts 33, and thus is electrically grounded.

Accordingly, because the connection parts 39 composed of the electrically conductive material that electrically connects the placing holder 38 and the support parts 33 are disposed, the placing holder 38 is electrically grounded. Thus, when the finger FN of the user is placed on the placing part 32 of the placing holder 38, the static electricity carried by the finger FN of the user is discharged to the placing holder 38.

Further, because the connection parts 39 are integrally movably disposed on two end parts of the placing holder 38 and the connection parts 39 are slidably in elastic contact with the pair of support parts 33 respectively, the connection parts 39 are constantly in contact with the pair of support parts 33. The placing holder 38 is electrically connected with the base 10 via the connection parts 39 and the pair of support parts 33, and then is electrically grounded. Therefore, when the finger FN of the user is placed on the placing part 32 of the placing holder 38, the static electricity carried by the finger FN of the user remains to be discharged to the placing holder 38.

Fifth Embodiment

FIG. 10 to FIG. 13 illustrate the fixing mechanism 30 of the printer P according to the fifth embodiment of the invention. In the printer P of this embodiment, the fixing mechanism 30 of the first embodiment is modified. Likewise, although the fifth embodiment illustrates a case where the finger of the user serves as the object, the object may be things other than the finger and may be a metal object, for example.

Figure 10:
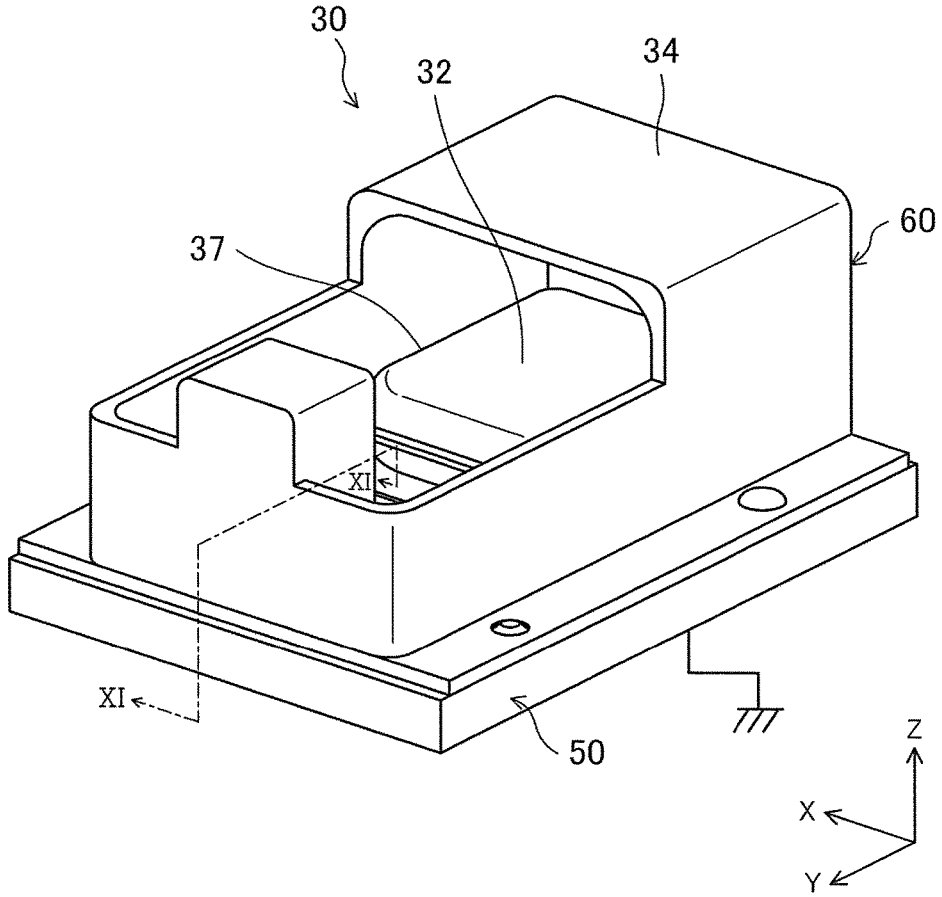
FIG. 10 is a perspective view showing the fixing mechanism according to the fifth embodiment of the invention.
Figure 14:
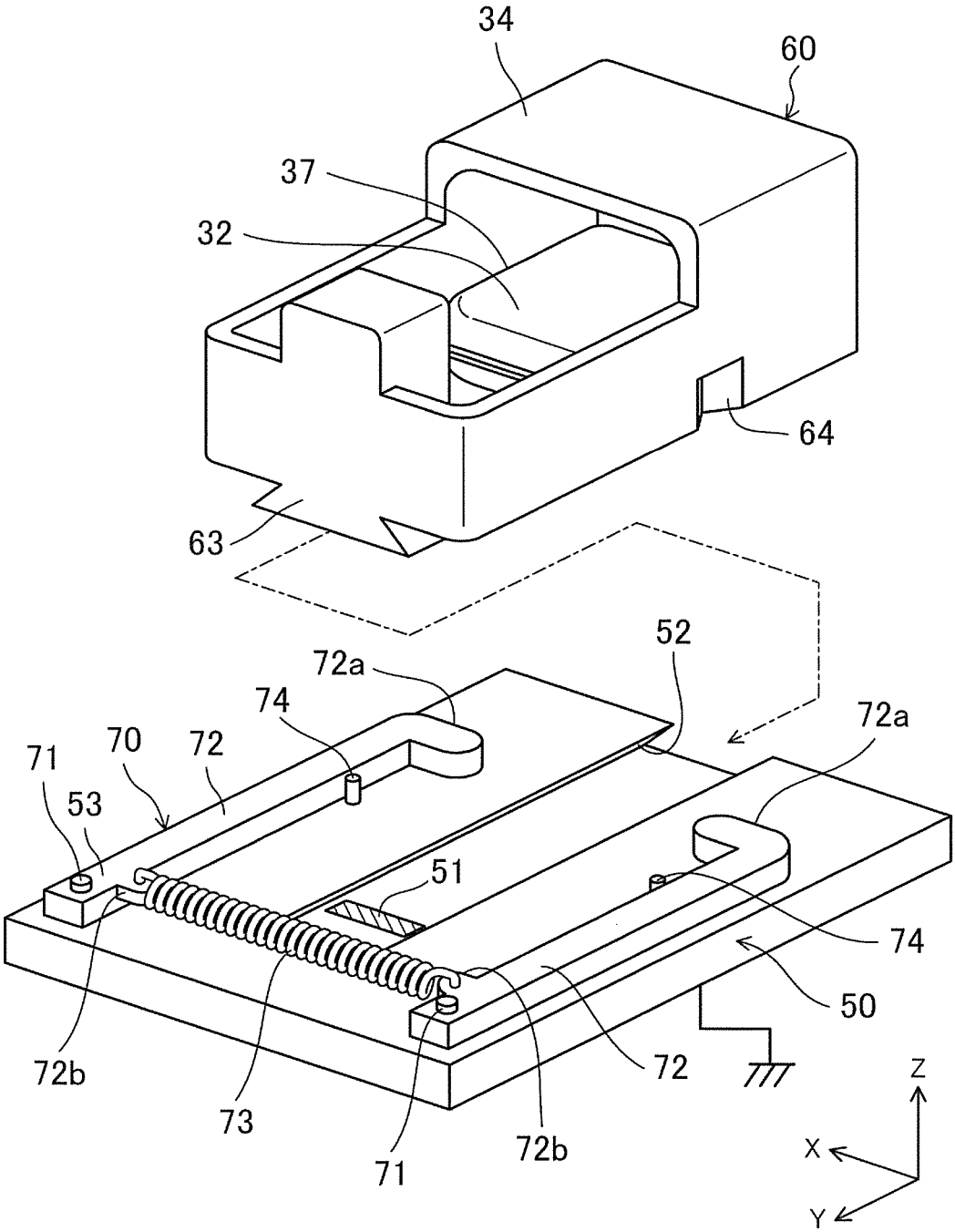
FIG. 14 is an exploded perspective view showing the fixing mechanism according to the sixth embodiment of the invention.

As shown in FIG. 10, a receiving part 50 is disposed on the fixing mechanism 30. The receiving part 50 is composed of an electrically conductive material electrically connected with the base 10. Moreover, a main body 60 is disposed on an upper side of the receiving part 50. The main body 60 is composed of a non-electrically conductive material and is configured to be detachable from the receiving part 50. For example, as shown in FIG. 14 (refer to the sixth embodiment), a dovetail groove 52 extending in the front-rear direction (the Y direction) is formed in the lateral central portion on the upper surface of the receiving part 50 and an engaging part 63 (dovetail tenon part) extending in the front-rear direction (the Y direction) is formed on the lower surface of the main body 60 to be engaged with the dovetail groove 52. The engagement of the engaging part 63 and the dovetail groove 52 allows the main body 60 to slide, and when the main body 60 is slid to the front end, the engaging part 63 is disengaged from the dovetail groove 52, so as to detach the main body 60 from the receiving part 50. While the main body 60 may be slid rearward to be installed in the receiving part 50, the main body 60 is adapted to be detached from the receiving part 50 when slid to the front. Moreover, same as the fixing mechanism 30 of the first embodiment, the main body 60 at least includes the positioning part 34. In this embodiment, the main body 60 also includes the urging member 37.

Figure 11:
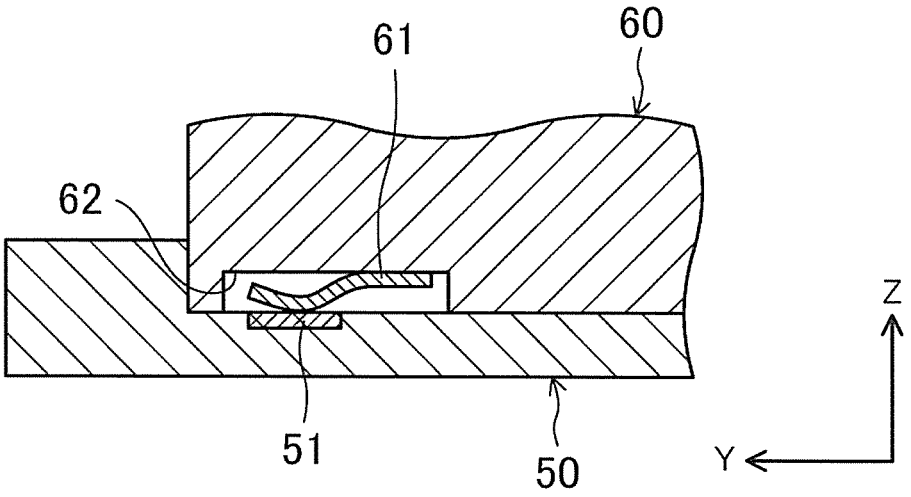
FIG. 11 is a cross-sectional view taken along the line XI-XI of FIG. 10.

The main body 60 is configured such that the positioning part 34 and the receiving part 50 are electrically connected with each other when the main body 60 is installed in the receiving part 50. As shown in FIG. 11, an accommodating part 62 recessed in a concave shape on the lower surface of the engaging part 63 is formed on the rear side of the main body 60, and a first electrode 61 is attached and fixed in the accommodating part 62. The first electrode 61 is composed of a plate spring or the like having a front end portion that is curved downward, and the front end portion is urged downward. Moreover, the first electrode 61 is electrically connected with the positioning part 34 via a conductive path not shown in the figure.

Figure 12:
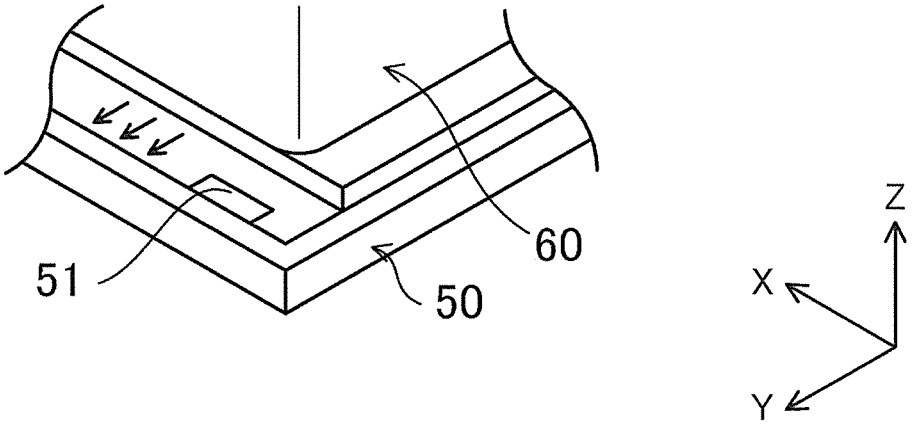
FIG. 12 is a perspective view showing a state where a main body is installed in a receiving part.

In addition, as shown in FIG. 11 and FIG. 12, a second electrode 51 is disposed on a rear end part of the upper surface of the receiving part 50. The second electrode 51 is disposed on the upper surface of the receiving part 50 to be in contact with the first electrode 61 when the main body 60 separated from the receiving part 50 (refer to FIG. 12) is installed in the receiving part 50 (refer to FIG. 10). In this way, when the two electrodes 61 and 51 are in contact to electrically connect the positioning part 34 and the receiving part 50, the main body 60 is installed at a regular position in the receiving part 50. In addition, the second electrode 51 is electrically connected with the base 10. That is, the second electrode 51 is electrically grounded.

Figure 13:
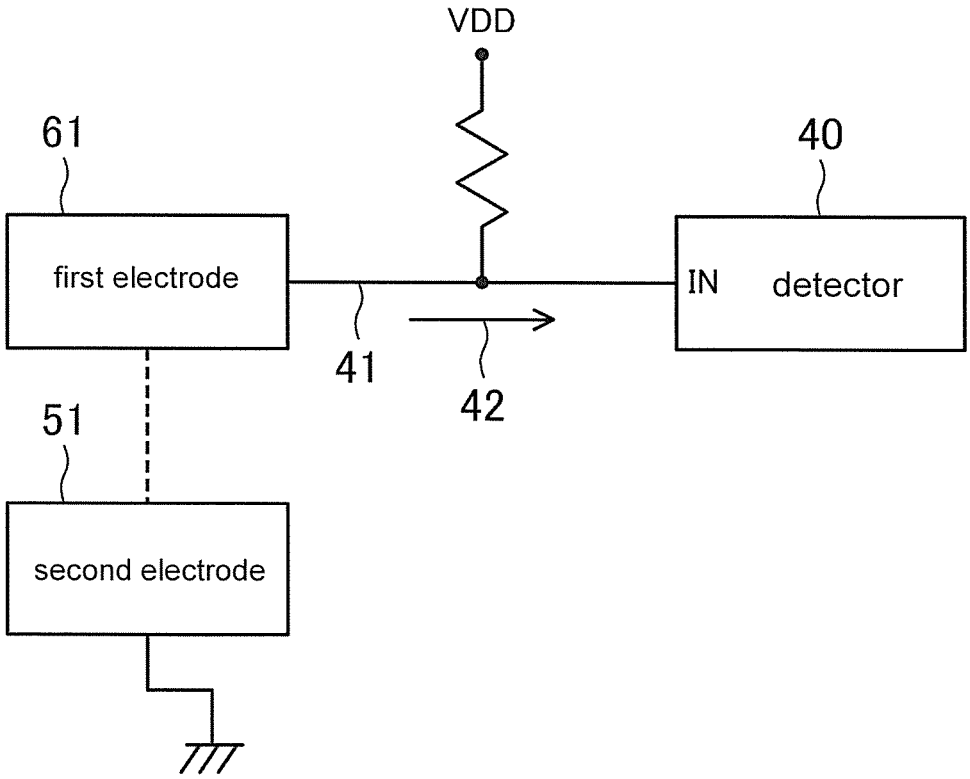
FIG. 13 is a circuit diagram showing the configuration of a detector.

Further, as shown in FIG. 13, a detector 40 composed of a CPU or the like is disposed in the fixing mechanism 30. The detector 40 is configured to detect whether the main body 60 is properly installed. More specifically, the detector 40 detects whether the main body 60 is installed in the receiving part 50 at the regular position where the positioning part 34 and the receiving part 50 are electrically connected with each other.

Specifically, as shown in FIG. 13, when the main body 60 is installed at the regular position in the receiving part 50, the detector 40 is inputted with a signal 42 that is transmitted through a signal line 41 when the first electrode 61 and the second electrode 51 are connected with each other. For example, the signal line 41 is pulled up to 3.3V. When the main body 60 is installed at the regular position in the receiving part 50, that is, when the first electrode 61 and the second electrode 51 are connected, a voltage level of the signal line 41 is in a ground level since the first electrode 61 is electrically grounded via the base 10 (frame ground level).

On the other hand, the detector 40 determines that the main body 60 is not properly installed in the receiving part 50 when the signal 42 of the signal line 41 is not at the ground level. That is, when the first electrode 61 and the second electrode 51 are not in contact when the main body 60 is installed in the receiving part 50 and then the signal 42 pulled up by the contact between the two electrodes 61 and 51 is not at the ground level, the detector 40 determines that the main body 60 is not installed at the regular position in the receiving part 50. Then, the detector 40 presumes that the main body 60 may not be installed at the regular position in the receiving part 50 and the static electricity carried by the finger FN of the user may not be properly discharged by the positioning part 34, and performs control to stop the operation of the ink printing mechanism 20, for example.

In this way, in the fixing mechanism 30 of this embodiment, even though the main body 60 is configured to be detachable from the receiving part 50, the positioning part 34 and the receiving part 50 are electrically connected with each other when the main body 60 is installed in the receiving part 50, and therefore movement of the finger FN of the user is restricted by the positioning part 34 for the ink printing mechanism 20 to perform printing stably and the static electricity carried by the finger FN of the user remains to be discharged properly by the positioning part 34, so as to suppress generation of static electricity. Moreover, the detector 40 presumes that the static electricity carried by the finger FN of the user may not be properly discharged by the positioning part 34 when the main body 60 is not installed at the regular position in the receiving part 50, and performs control to stop the operation of the ink printing mechanism 20, for example, so as to prevent malfunction of the nozzle caused by the static electricity in advance.

Sixth Embodiment

Figure 15:
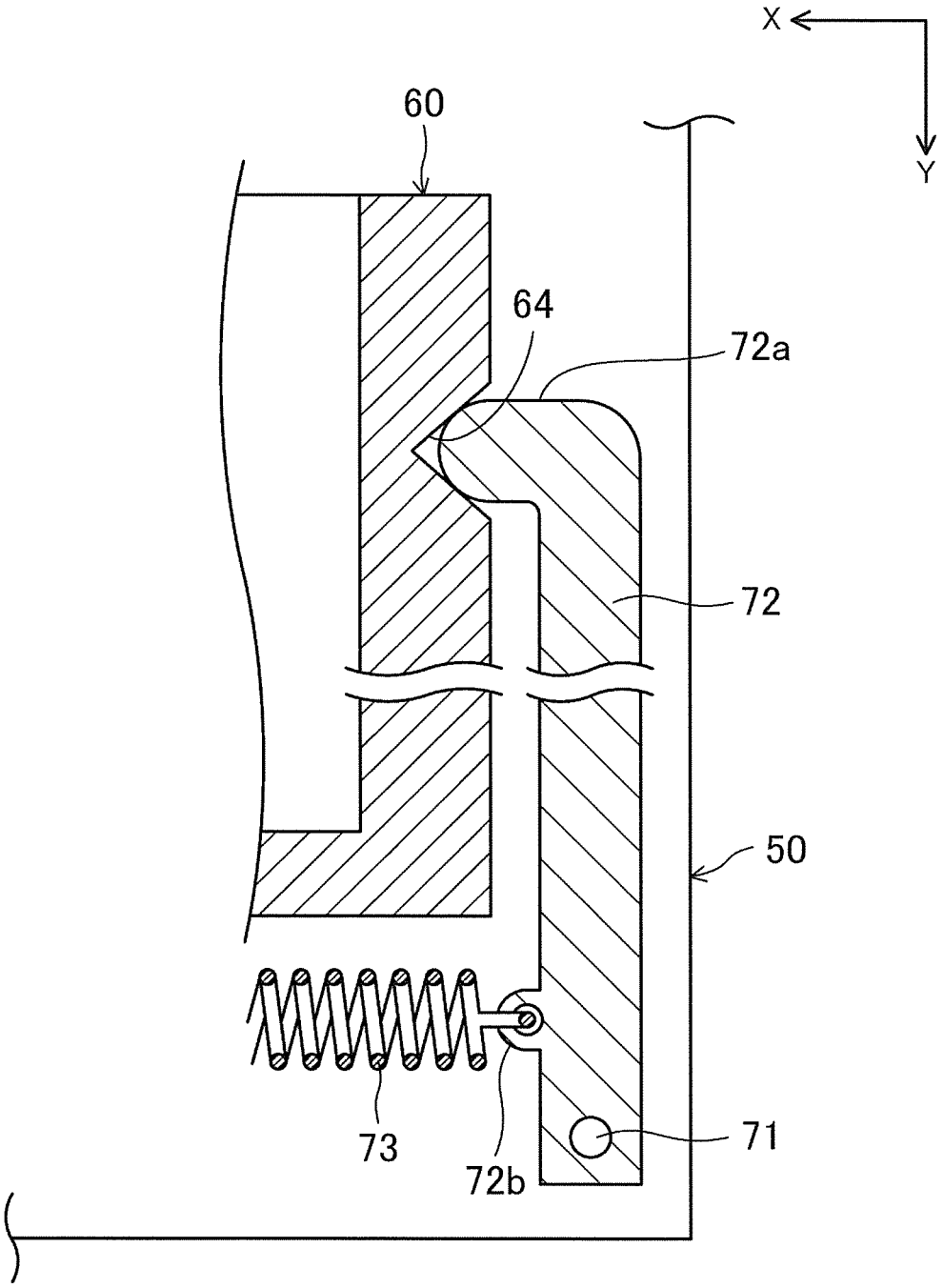
FIG. 15 is a transverse cross-sectional view enlarging a fitting state of the main body and the holding part.

FIG. 14 and FIG. 15 illustrate the fixing mechanism 30 of the printer P according to the sixth embodiment of the invention. The printer P of this embodiment further includes a holding part in the fixing mechanism 30 of the fifth embodiment. Other parts of the configuration are the same as those of the fifth embodiment. Likewise, although the sixth embodiment illustrates a case where the finger of the user serves as the object, the object may be things other than the finger and may be a metal object, for example.

That is, in this embodiment, a pair of shaft parts 71 is disposed to protrude on the rear end of left and right sides of the upper surface of the receiving part 50. The shaft parts 71 respectively have an axis that extends in the vertical direction (the Z direction). The shaft parts 71 respectively support base ends of a pair of arms 72 that is respectively swingable in the left-right direction (the X direction) around an axial direction of the shaft part 71. Protrusion parts 72*a* are respectively formed on front end portions of the arms 72 by bending the front end portions toward the inner side of the receiving part 50. In addition, semicircular spring engaging parts 72*b* are formed on inner side portions of the arms 72 near the shaft parts 71. A coiled tension spring 73 is stretched and installed on the two spring engaging parts 72*b*. The tension spring 73 rotationally urges the pair of arms 72 respectively to move the protrusion parts 72*a* toward the inner side of the receiving part 50. A pair of stopper pins 74 respectively protrudes on the upper part of the receiving part 50 and is located to contact the inner sides of the arms 72. The stopper pins 74 prevent the arms 72 from being rotated inward excessively by the tension spring 73 when the main body 60 is not held by the receiving part 50. In addition, engaging recesses 64 are formed close to the front side on the lower part on the left and right side surfaces of the main body 60. The engaging recesses 64 respectively have a V-shaped cross-section to be engaged with the protrusion parts 72*a* of the arms 72.

As shown in FIG. 15, when the main body 60 is installed at the regular position in the receiving part 50, the protrusion parts 72*a* of the arms 72 are engaged with the engaging recesses 64 of the main body 60. At the moment, the arms 72 are urged in an inward direction of the receiving part 50 by the urging force of the tension spring 73. Thus, the protrusion parts 72*a* of the arms 72 remain engaged with the engaging recesses 64 of the main body 60.

In this way, in this embodiment, the holding part 70 for installing the main body 60 at the regular position in the receiving part 50 to keep the positioning part 34 and the receiving part 50 electrically connected with each other includes the shaft parts 71, the arms 72, and the tension spring 73. With the holding part 70, the static electricity carried by the finger FN of the user remains to be properly discharged by the positioning part 34.

Seventh Embodiment

Figure 16:
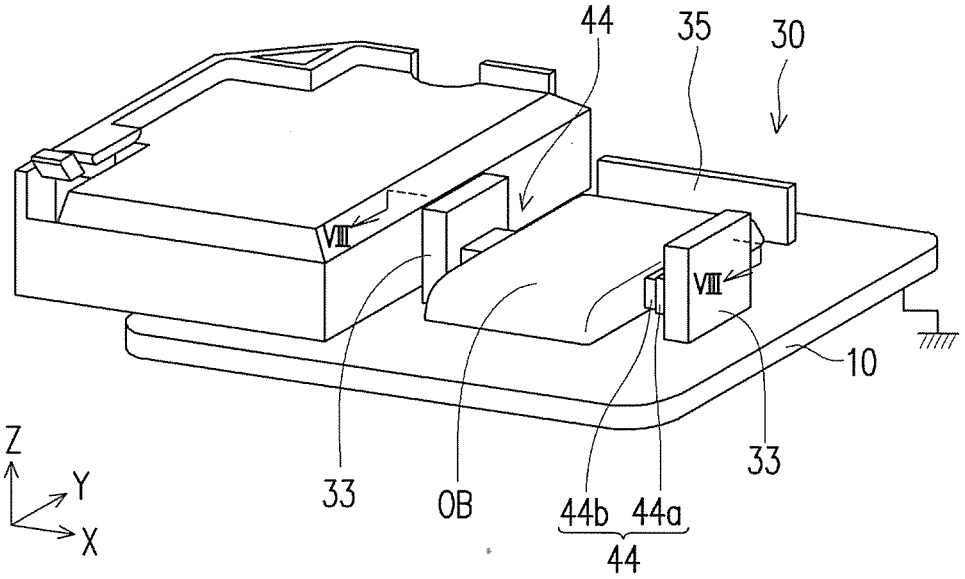
FIG. 16 is a perspective view showing the fixing mechanism according to the seventh embodiment.
Figure 17:
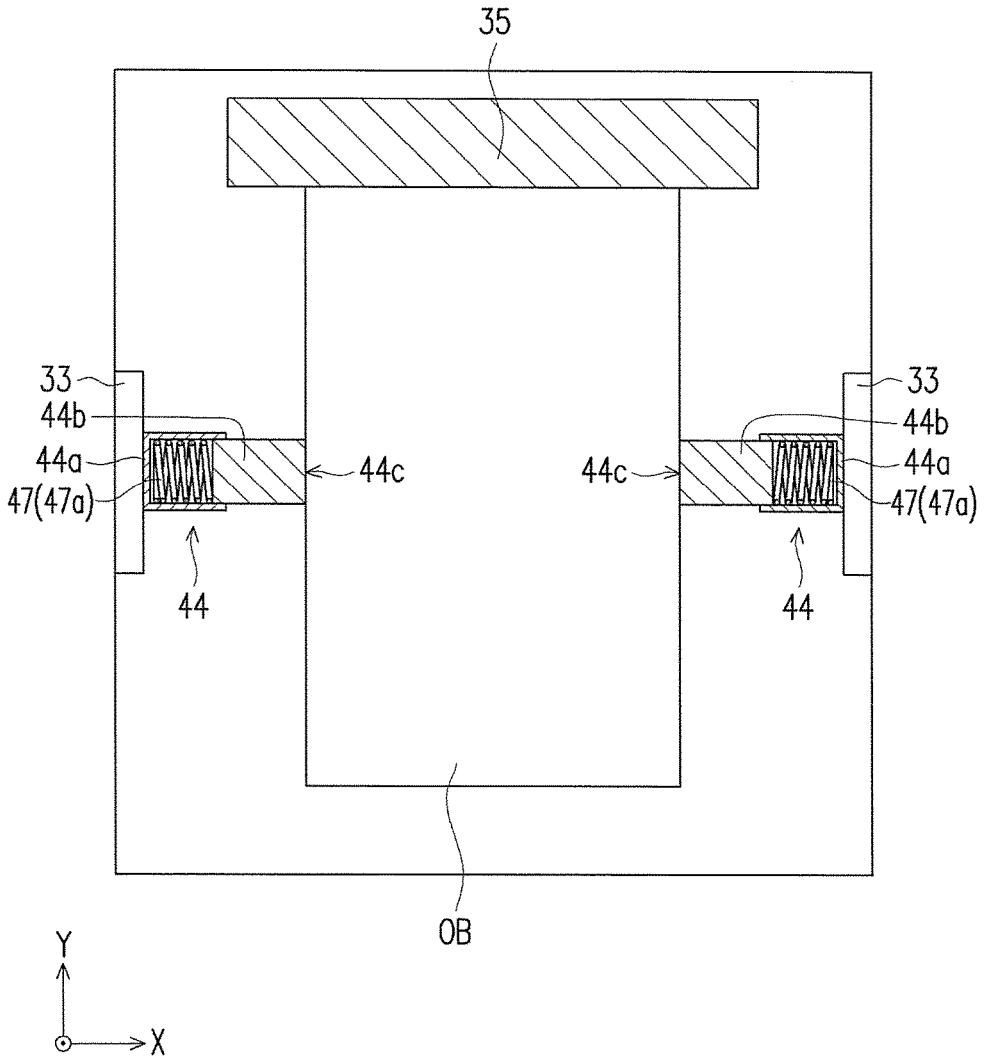
FIG. 17 is a plan view showing the fixing mechanism according to the seventh embodiment of the invention.
Figure 18:
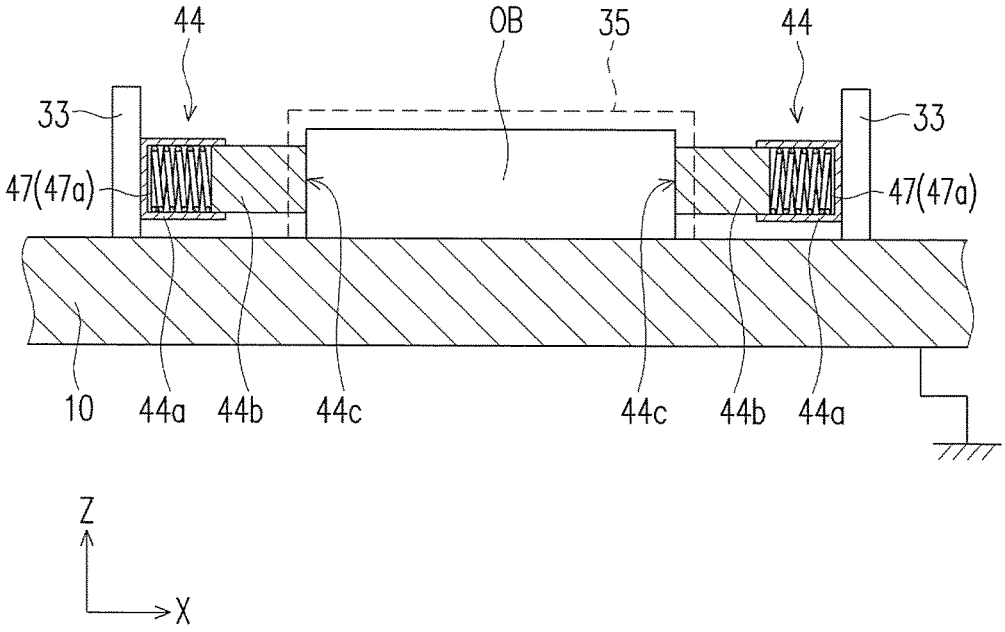
FIG. 18 is a cross-sectional view taken along the line VIII-VIII of FIG. 16 showing the fixing mechanism according to the seventh embodiment of the invention.

FIG. 16 to FIG. 18 illustrate the fixing mechanism 30 of the printer P according to the seventh embodiment of the invention. In the printer P of this embodiment, the fixing mechanism 30 of the first embodiment is modified.

As shown in FIG. 16 to FIG. 18, the base 10 is electrically grounded. An object OB to be placed on the base 10 is a mobile phone, for example, but not particularly limited thereto. Moreover, the fixing mechanism 30 further includes a pair of positioning parts 44 that is respectively disposed on inner wall surfaces of support parts 33 (having a structure or function similar to that of the support part of the first embodiment and so on) to hold the object OB from the left and right sides (the X direction in the figure) of the object OB. The support parts 33 are composed of an electrically conductive material (e.g., an electrically conductive resin). That is, the support parts 33 are electrically connected with the base 10 and are electrically grounded.

As shown in FIG. 17 to FIG. 18, the pair of positioning parts 44 respectively includes a body part 44*a*, an urging member 47, and a gripping part 44*b*, for example. The body part 44*a* may be fixed to the inner wall surface of the support part 33 at a predetermined height. The urging member 47 (a compression spring 47*a* in this embodiment, for example) is disposed in the body part 44*a* with an end in contact with the gripping part 44*b*. A front end 44*c* of the gripping part 44*b* is used for fixing the object OB. When the object OB is placed between the pair of positioning parts 44, the gripping parts 44*b* press down the compression spring 47*a* and the object OB is fixed by the urging force of the urging member 47*a*. That is, because of the urging force of the compression spring 47*a*, two sides of the object OB are pressed by the front ends 44*c* of the gripping parts 44*b* of the positioning parts 44. In this state, the ink printing mechanism 20 operates to apply printing on the object OB. Additionally, the pair of positioning parts 44 is composed of an electrically conductive material (e.g., an electrically conductive resin). That is, the positioning parts 44 are electrically connected with the base 10 via the pair of left and right support parts 33 and are electrically grounded.

Because such action of the urging member 47 (the compression spring 47*a*) more strongly restricts movement of the object OB with respect to the positioning parts 44, the ink printing mechanism 20 is able to print the object OB stably. In addition, the object OB is pressed against the positioning parts 44, by which the static electricity carried by the object OB remains to be discharged by the positioning parts 44. Thus, generation of static electricity is suppressed.

Furthermore, as shown in FIG. 16, the seventh embodiment is similar to the first embodiment in that a front wall part 35 is disposed on a front side of an insertion direction (the Y direction) of the object OB. The front wall part 35 restricts forward movement (the Y direction) of the object OB fixed by the positioning parts 44.

Variation of the Seventh Embodiment

Figure 19A:
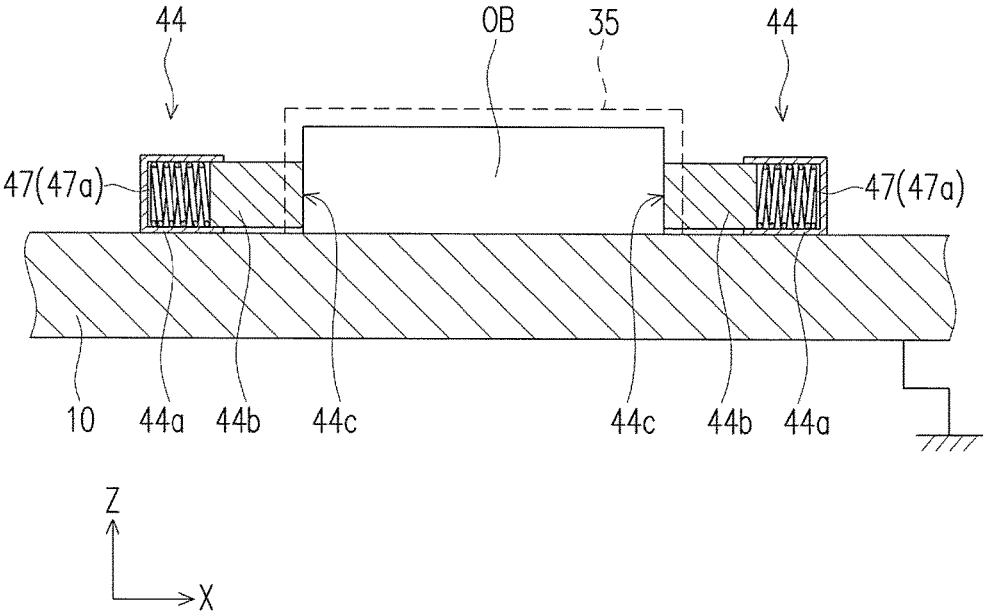
FIG. 19A and FIG. 19B are cross-sectional views showing variations of the seventh embodiment of the invention.
Figure 19B:
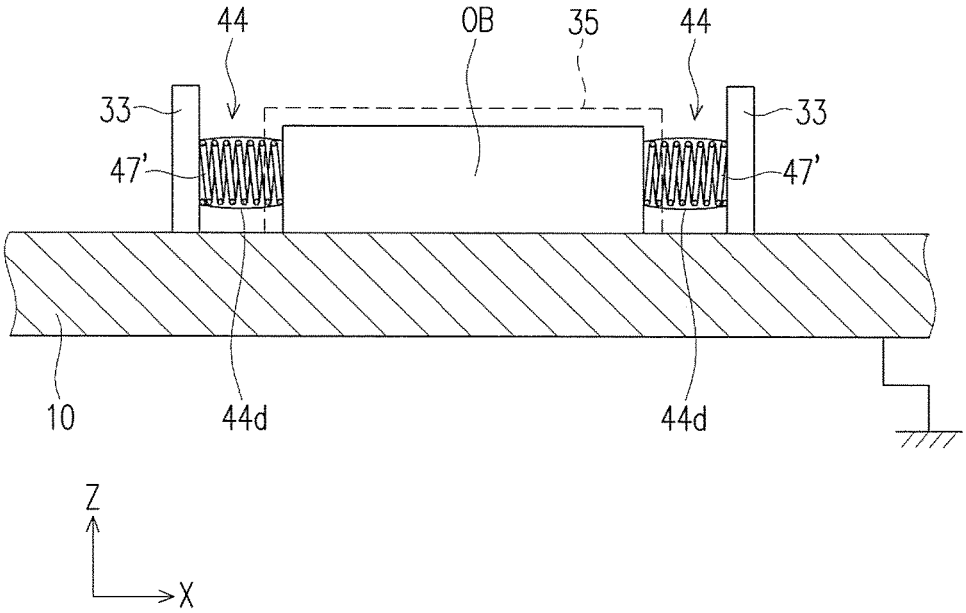

As a variation of the seventh embodiment, as shown in FIG. 19A, the pair of positioning parts 44 is disposed on the base 10, but the support parts 33 may be omitted. Likewise, the pair of positioning parts 44 is respectively composed of an electrically conductive material (e.g., an electrically conductive resin). That is, the positioning parts 44 are electrically connected with the base 10 and are electrically grounded. In addition, as another variation of the seventh embodiment, as shown in FIG. 19B, the pair of positioning parts 44 is configured in the same manner as the first embodiment. For example, the pair of positioning parts 44 respectively includes an urging member 47' (e.g., a compression spring) attached to the support part 33 and an expandable bag-shaped housing body 44*d* that houses the urging member 47' therein.

Eighth Embodiment

Figure 20:
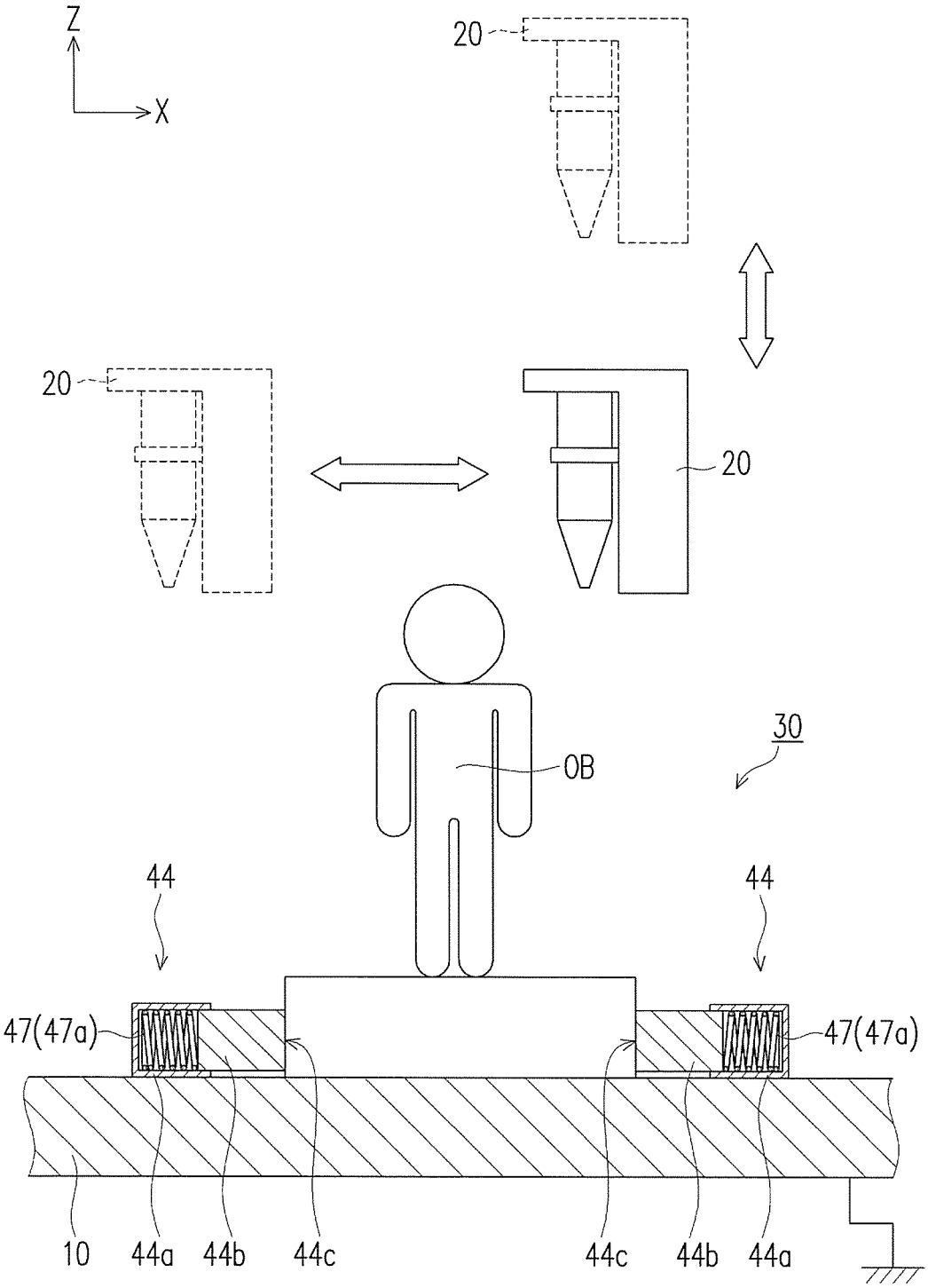
FIG. 20 is a schematic view in the Y direction showing the fixing mechanism according to the eighth embodiment.

FIG. 20 illustrates the fixing mechanism 30 of the printer P according to the eighth embodiment of the invention. In the eighth embodiment, a 3D printer used for surface printing of a three-dimensional object is depicted. Likewise, the base 10 is electrically grounded. The ink printing mechanism 20 of the printer P described in the first to the seventh embodiments is capable of moving in the XY plane with use of the X-axis motor 21, the Y-axis motor 23, the X-axis motor belt 22, and the Y-axis motor shaft 24. In the eighth embodiment, a set of a Z-axis motor and a Z-axis motor shaft, or the Z-axis motor and a Z-axis motor belt are added for moving the ink printing mechanism 20 in the Z axis direction. With the three sets of motors, the ink printing mechanism 20 of the printer P is able to move in the XYZ axes to perform printing on the surface of the three-dimensional object OB.

As shown in FIG. 20, the fixing mechanism 30 of this embodiment includes a pair of positioning parts 44 disposed on the base 10. The positioning parts 44 have the same structure as described in the variation of the seventh embodiment and FIG. 19. With the urging member 47 of the positioning part 44, the gripping part 44*b* grips a base or a bottom of the object OB, so as to restrict movement of the object OB. Additionally, the pair of positioning parts 44 is composed of an electrically conductive material (e.g., an electrically conductive resin). That is, the positioning parts 44 are electrically connected with the base 10 and are electrically grounded. If the object OB is a metal object, a finger, or an object that carries static electricity easily, this structure makes it possible to remove the static electricity and prevent the static electricity from damaging the nozzle of the ink printing mechanism.

Accordingly, the object OB is pressed against the positioning parts 44 such that the static electricity carried by the object OB remains to be discharged by the positioning parts 44. Thus, generation of static electricity is suppressed. Moreover, because such action of the urging member 47 (the compression spring 47*a*) more strongly restricts movement of the object OB with respect to the positioning parts 44, the ink printing mechanism 20 is able to print the object OB stably.

Variation of the Eighth Embodiment

Figure 21:
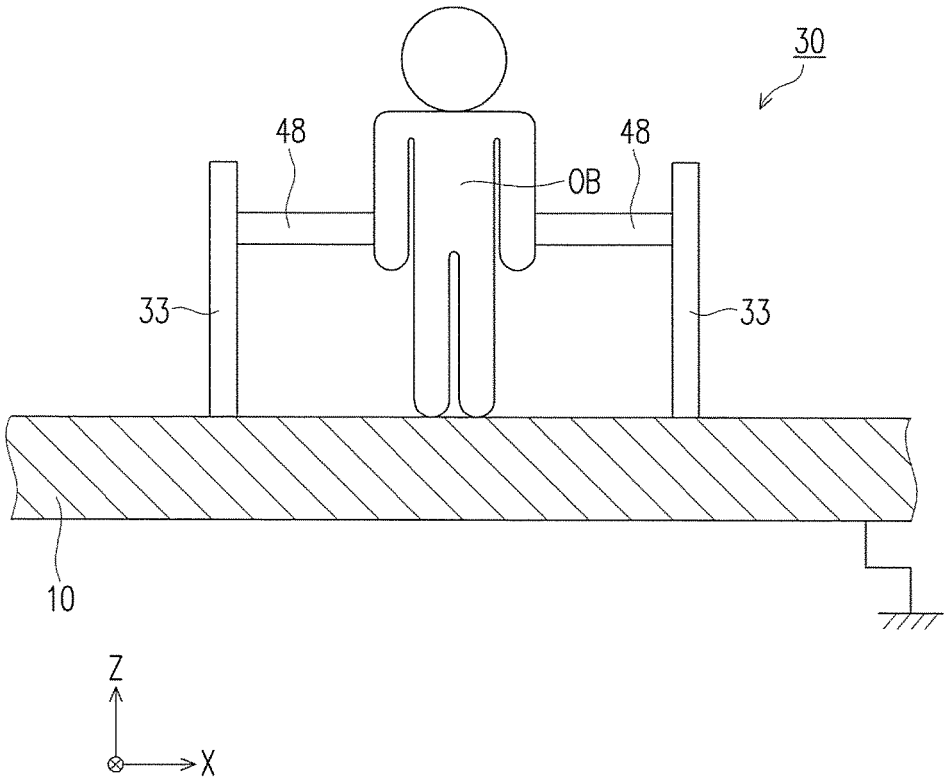
FIG. 21 is a cross-sectional view showing a variation of the eighth embodiment.
Figure 22:
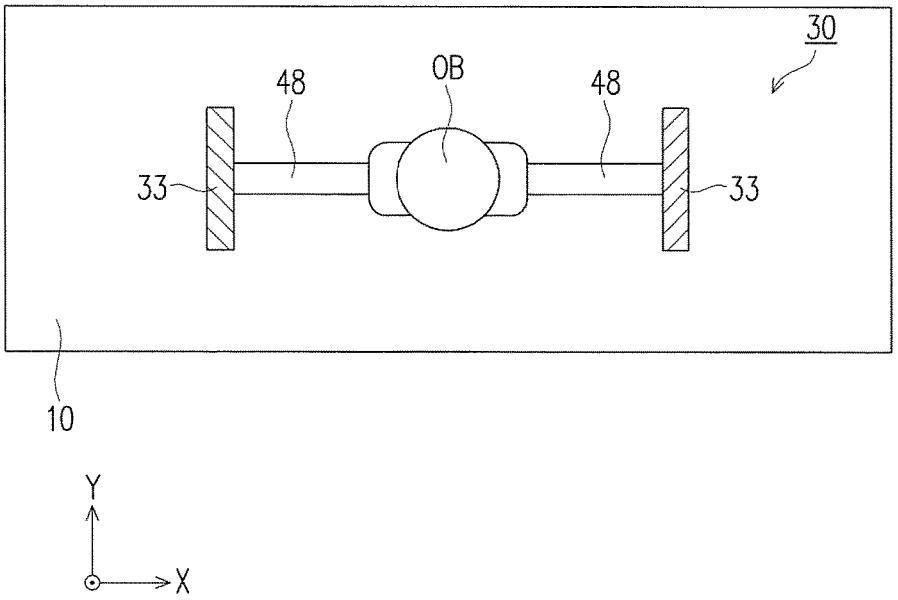
FIG. 22 is a plan view showing the variation of the eighth embodiment.

FIG. 21 to FIG. 22 illustrate a variation of the eighth embodiment. FIG. 21 is a plan view in the Y direction and FIG. 22 is a plan view in the Z direction. In this embodiment, a pair of relatively small positioning parts 48 is used to fix the object OB. The urging member 47 is respectively disposed on the inner wall surfaces of a pair of support parts 33 and has a predetermined height on the surface of the base 10. Positions for fixing the pair of positioning parts 48 to the object OB are set such that the nozzle of the ink printing mechanism 20 does not affect the printing of the object OB. The pair of positioning parts 48 basically has the same structure as shown in FIG. 18. Likewise, the pair of positioning parts 48 is composed of an electrically conductive material (e.g., an electrically conductive resin). The pair of support parts 33 is also composed of an electrically conductive material (e.g., electrically conductive resin). Accordingly, the pair of positioning parts 48 is electrically connected with the base 10 via the support parts 33 and is electrically grounded.

Other Embodiments

The printer P of the first embodiment is in a form that includes the urging member 37 as the fixing mechanism 30, but not limited thereto. That is, the fixing mechanism 30 may not include the urging member 37. In short, the printer P has a configuration that includes the placing part 32 for placing the object (e.g., the finger FN of the user) and the positioning part 34 as the fixing mechanism 30, and it may be in any form as long as the movement of the object is restricted during printing of the ink printing mechanism 20 and the static electricity carried by object remains to be discharged to the positioning part 34.

The printer P of the second and third embodiments is in a form that the placing holder 38 is rotatable in the up-down direction (the Z direction) around the rotating shaft 38*b*, but not limited thereto. For example, it may have a form that the placing part 32 on the upper surface of the placing holder 38 is raised and lowered in the up-down direction while maintaining a horizontal state. In short, it may have any form as long as the placing holder 38 is movable in the direction toward or away from the positioning part 34.

The printer P of the fourth embodiment is in a form that the pair of connection parts 39 is respectively formed integrally with two end parts of the placing holder 38, but not limited thereto. That is, it may have a form that the pair of connection parts 39 and the placing holder 38 are connected with each other as separate members.

The printer P of the fifth and sixth embodiments is in a form that the fixing mechanism 30 disposed on the main body 60 includes the positioning part 34 and the urging member 37, but not limited thereto. For example, the fixing mechanism 30 may include the placing holder 38 of the second to the fourth embodiments. Or, the fixing mechanism 30 may include the connection parts 39 of the fourth embodiment.

In the printer P of the seventh and eighth embodiments, the pair of positioning parts 44 (48) is disposed. However, a plurality of positioning parts may be disposed instead according to the actual needs. Besides, the pair of positioning parts 44 (48) is fixed to be disposed on the inner wall surfaces of the support parts. However, the pair of positioning parts 44 (48) may also be disposed to move vertically in the Z direction on the inner wall surfaces, so as to correspond to printing objects having various sizes.

In the embodiments of the invention described above, the printer may discharge droplets of a fluid obtained by mixing cosmetics or medicine for skin into a liquid in place of the ink. Thereby, cosmetics or medicine may be applied to human skin with high accuracy, for example.

Some embodiments of the invention have been described above. However, the invention should not be construed as limited to the above embodiments and various modifications are possible within the scope of the invention.

The invention is industrially applicable as an ejection device for discharging droplets of a fluid or the like to an object.

What is claimed is:

1. An ejection device, comprising:

a discharge part discharging a droplet to an object;

a base electrically grounded; and a fixing mechanism disposed on the base and fixing the object, wherein the fixing mechanism includes an electrically conductive material and is electrically connected with the base, wherein the fixing mechanism further includes an insertion part, the object is inserted into the fixing mechanism from the insertion part, the insertion part includes a pair of support parts extending from the base and a positioning part being permanently disposed on the upper portions of the pair of the support parts, lower portions of the pair of support parts connect to the base, the positioning part restricts movement of the object.

2. The ejection device according to claim 1, wherein the pair of support parts and the positioning part are composed of an electrically conductive material.

3. The ejection device according to claim 1, wherein the fixing mechanism comprises a placing part on which the object is placed.

4. The ejection device according to claim 3, wherein the fixing mechanism comprises the positioning part which is disposed to face the placing part and is in contact with the object placed on the placing part to restrict movement of the object.

5. The ejection device according to claim 4, wherein the positioning part comprises a contact part which is curved in a concave shape to conform to a cross-sectional shape of the object placed on the placing part.

6. The ejection device according to claim 3, wherein the placing part is disposed movably in a direction toward or away from the positioning part, and the fixing mechanism comprises an urging member which urges the placing part toward the positioning part to bring the object placed on the placing part into contact with the positioning part.

7. The ejection device according to claim 6, wherein the fixing mechanism comprises a placing holder on which the placing part is formed and which is movable in the direction toward or away from the positioning part, and the placing holder is urged in the direction toward the positioning part by an urging force of the urging member.

8. The ejection device according to claim 7, wherein the urging member includes an electrically conductive material electrically connected with the base.

9. The ejection device according to claim 8, wherein the placing holder includes an electrically conductive material electrically connected with the urging member.

10. The ejection device according to claim 7, wherein the fixing mechanism comprises a support part which supports the positioning part on the base and includes an electrically conductive material electrically connected with the base and the positioning part respectively, and a connection part composed of an electrically conductive material to electrically connect the placing holder and the support part is disposed.

11. The ejection device according to claim 10, wherein the support part comprises a pair of support parts disposed on two lateral sides of the placing holder, the connection part is integrally and movably disposed on two end parts of the placing holder, and the connection part includes an elastic material to be slidably in contact with the pair of support parts respectively.

12. The ejection device according to claim 1, wherein the fixing mechanism comprises:

a receiving part composed of an electrically conductive material electrically connected with the base; and a main body detachably disposed in the receiving part and at least comprising the positioning part, wherein the main body is configured such that the positioning part is electrically connected with the receiving part when the main body is installed in the receiving part.

13. The ejection device according to claim 12, wherein a detector is disposed which detects that the main body is installed in the receiving part at a regular position where the positioning part is electrically connected with the receiving part.

14. The ejection device according to claim 13, wherein the main body comprises a first electrode which is electrically connected with the positioning part, the receiving part comprises a second electrode which is electrically connected with the base and is in contact with the first electrode when the main body is installed at the regular position, and the detector determines that the main body is not installed at the regular position in the receiving part when the first electrode and the second electrode does not properly in contact.

15. The ejection device according to claim 12, wherein the fixing mechanism comprises a holding part which maintains a state where the main body is installed at the regular position in the receiving part to electrically connect the positioning part and the receiving part with each other.

16. An ejection device, comprising:

a discharge part discharging a droplet to an object;

a base electrically grounded; and a fixing mechanism disposed on the base and fixing the object, wherein the fixing mechanism includes an electrically conductive material and is electrically connected with the base, and the fixing mechanism discharges static electricity carried by the object to the base, wherein the fixing mechanism comprises a support part disposed on the base, and a positioning part disposed on the support part and restricting movement of the object, and the support part and the positioning part are composed of an electrically conductive material, wherein the positioning part comprises a body part disposed on the support part, an urging member disposed in the body part, and a gripping part having an end coupled to the urging member and the other end in contact with the object, wherein the end coupled to the urging member is opposite to the other end in contact with the object.

17. An ejection device, comprising:

a discharge part discharging a droplet to an object;

a base electrically grounded; and a fixing mechanism disposed on the base and fixing the object, wherein the fixing mechanism includes an electrically conductive material and is electrically connected with the base, and the fixing mechanism discharges static electricity carried by the object to the base, wherein the fixing mechanism comprises the positioning part disposed on the base and restricting movement of the object, and the positioning part includes an electrically conductive material, wherein the positioning part comprises a body part disposed on the base, the urging member disposed in the body part, and a gripping part having one end coupled to the urging member and the other end in contact with the object, wherein the one end coupled to the urging member is opposite to the other end in contact with the object.

* * * * *